US008956794B2

(12) United States Patent
Yamamoto

(10) Patent No.: US 8,956,794 B2
(45) Date of Patent: Feb. 17, 2015

(54) ELECTROPHOTOGRAPHIC PHOTORECEPTOR, PROCESS CARTRIDGE, AND IMAGE FORMING APPARATUS

(71) Applicant: Fuji Xerox Co., Ltd., Tokyo (JP)

(72) Inventor: Shinya Yamamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/633,412

(22) Filed: Oct. 2, 2012

(65) Prior Publication Data

US 2013/0252153 A1 Sep. 26, 2013

(30) Foreign Application Priority Data

Mar. 26, 2012 (JP) ..... 2012-070222

(51) Int. Cl.
*G03G 5/14* (2006.01)

(52) U.S. Cl.
USPC ..... 430/63; 430/61; 430/62

(58) Field of Classification Search
CPC ..... G03G 5/142; G03G 5/144; G03G 15/00
USPC ..... 430/61, 62, 63
See application file for complete search history.

(56) References Cited

U.S. PATENT DOCUMENTS

2005/0064309 A1 3/2005 Itami
2011/0217640 A1* 9/2011 Hashiba et al. ..... 430/56

FOREIGN PATENT DOCUMENTS

JP A-05-088393 4/1993
JP A-2005-115356 4/2005

* cited by examiner

*Primary Examiner* — Peter Vajda
(74) *Attorney, Agent, or Firm* — Oliff PLC

(57) ABSTRACT

A negative-charge type electrophotographic photoreceptor includes a conductive substrate; an undercoat layer which includes a binder resin and metal oxide particles and in which the work function is from 4.0 eV to 4.7 eV; a charge generation layer in which a difference between the work functions of the charge generation layer and the undercoat layer is from −4 eV to 0 eV; and a charge transport layer which is provided on the charge generation layer.

13 Claims, 3 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2012-070222 filed Mar. 26, 2012.

BACKGROUND

Technical Field

The present invention relates to an electrophotographic photoreceptor, a process cartridge, and an image forming apparatus.

SUMMARY

According to an aspect of the invention, there is provided a negative-charge type electrophotographic photoreceptor including a conductive substrate; an undercoat layer which includes a binder resin and metal oxide particles and in which the work function is from 4.0 eV to 4.7 eV; a charge generation layer in which a difference between the work functions of the charge generation layer and the undercoat layer is from −4 eV to 0 eV; and a charge transport layer which is provided on the charge generation layer.

BRIEF DESCRIPTION OF THE DRAWINGS

Exemplary embodiments of the present invention will be described in detail based on the following figures, wherein.

DETAILED DESCRIPTION

Figure 1:
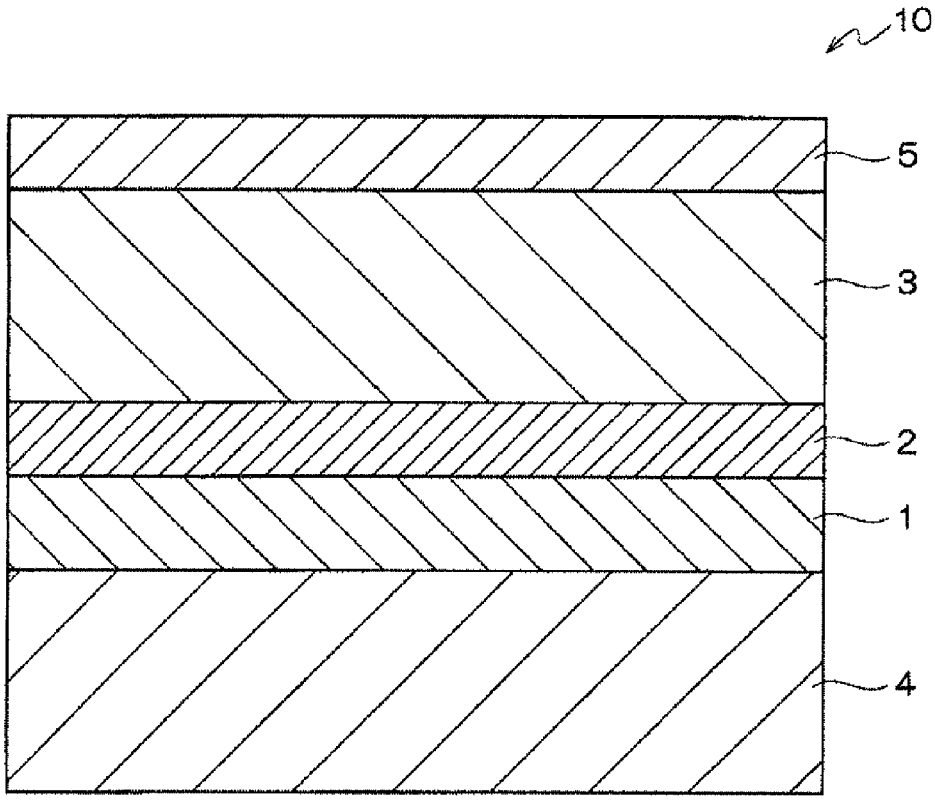
FIG. 1 is a cross-sectional view schematically illustrating a part of an electrophotographic photoreceptor according to an exemplary embodiment of the invention.

Hereinafter, an exemplary embodiment which is an example of the invention will be described.

Electrophotographic Photoreceptor

An electrophotographic photoreceptor according to the exemplary embodiment is a negative-charge type organic electrophotographic photoreceptor which includes a conductive substrate and a laminate in which an undercoat layer containing metal oxide particles, a charge generation layer, and a charge transport layer are laminated in this order on the conductive substrate. In addition, a surface protective layer may be further laminated on the charge transport layer.

In addition, the work function of the undercoat layer is from 4.0 eV to 4.7 eV (preferably from 4.2 eV to 4.7 eV and more preferably from 4.45 eV to 4.65 eV).

The difference between the work functions of the charge generation layer and the undercoat layer (the work function of the charge generation layer—the work function of the undercoat layer) is from −4 eV to 0 eV (preferably from −3.5 eV to −0.05 eV and more preferably from −3 eV to −2 eV).

The work function of the charge generation layer is, for example, from 4 eV to 4.7 eV (preferably from 4.1 eV to 4.5 eV and more preferably from 4.2 eV to 4.4 eV).

In this case, in image forming processes using the electrophotographic photoreceptor, charging, exposure, developing, and transfer processes for an electrophotographic photoreceptor are set to one cycle, a toner image is formed on the electrophotographic photoreceptor, and the toner image is transferred onto a recording medium. Then, the cycle proceeds to the subsequent process.

However, in the subsequent process, a ghost (unevenness in density caused by exposure history) in which the sensitivity of an exposed portion of the electrophotographic photoreceptor increases in the previous cycle and only the image density of this portion increases, may occur. The reason is considered that in a portion having exposure history, hole carriers remain on the surface thereof without being moved completely during the cycle; and due to this carrier, the charged potential in the subsequent cycle may drop or dark decay may occur to a large degree.

Therefore, the electrophotographic photoreceptor according to the exemplary embodiment may adopt the above-described configuration to obtain an image in which the occurrence of a ghost (unevenness in density caused by exposure history) is suppressed.

The reason is not clear but is presumed to be as follows.

Usually, when an uncharged electrophotographic photoreceptor is exposed, electrons among charges (electrons and holes), which are generated in a charge generation layer, are injected into an undercoat layer. However, it is considered that, when the work function of the undercoat layer is high in the above-described range and the difference between the work functions of the charge generation layer and the undercoat layer is in the above-described range, the injection of charges into the undercoat layer is difficult and thus the electrons accumulate in the interface between the charge generation layer and the undercoat layer. The reason is considered that the above difference between the work functions indicates that the energy level of the undercoat layer is higher than that of the charge generation layer in a state where the charge generation layer and the undercoat layer are laminated (joined); due to this higher energy level, electrons generated in the charge generation layer may not move to the undercoat layer; and thus the electrons accumulate in the interface between the charge generation layer and the undercoat layer.

In addition, it is considered that, when the subsequent cycle is performed in this state, the sensitivity of the exposed portion in the previous cycle deteriorates and the image density deteriorates because the electrons accumulate in the interface between the charge generation layer and the undercoat layer. Accordingly, it is considered that the amount of the sensitivity of the exposed portion increased in the previous cycle is balanced out.

As described above, in the electrophotographic photoreceptor according to the exemplary embodiment, it is considered that an image in which the occurrence of a ghost (unevenness in density caused by exposure history) is suppressed may be obtained.

In addition, in an image forming apparatus (and a process cartridge) using the electrophotographic photoreceptor according to the exemplary embodiment, it is considered that an image in which the occurrence of a ghost (unevenness in density caused by exposure history) is suppressed may be also obtained.

In this case, the work functions of the undercoat layer and the charge generation layer are obtained as follows.

First, the powder of a measurement target layer is collected from the electrophotographic photoreceptor by a cutter or the like to collect measurement samples.

The collected measurement samples are placed on a gold electrode. Then, the contact potential difference when Au is a counter electrode is measured using a Kelvin probe and the work function of the layer is measured. Optionally, the powder samples may be, for example, pressed against the gold electrode as needed.

Hereinafter, the electrophotographic photoreceptor according to the exemplary embodiment will be described in detail with reference to the drawings.

FIG. 1 schematically illustrates a part in cross-section of an electrophotographic photoreceptor 10 according to the exemplary embodiment.

The electrophotographic photoreceptor 10 illustrated in FIG. 1 includes a photosensitive layer in which a charge generation layer 2 and a charge transport layer 3 are separately provided (functional separation type photoreceptor).

Specifically, the electrophotographic photoreceptor 10 illustrated in FIG. 1 includes a conductive substrate 4, and an undercoat layer 1, the charge generation layer 2, the charge transport layer 3, and a protective layer 5 are provided in this order on the conductive substrate 4.

The electrophotographic photoreceptor 10 illustrated in FIG. 1 includes the protective layer 5, but the protective layer 5 is optionally provided.

Hereinafter, the respective components of the electrophotographic photoreceptor 10 will be described. In addition, the description will be made without reference numerals.

Conductive Substrate

Any conductive substrates may be used as long as they are used in the related art. Examples thereof include plastic films in which a thin layer (for example, a layer of metals such as aluminum, nickel, chromium, and stainless steel and a layer of aluminum, titanium, nickel, chromium, stainless steel, gold, vanadium, tin oxide, indium oxide, indium tin oxide (ITO), and the like) is provided; papers to which a conductivity imparting agent is applied or impregnated; and plastic films to which a conductivity imparting agent is applied or impregnated. The shape of the substrate is not limited to a cylindrical shape and may be a sheet shape and a plate shape.

When a metal pipe is used as the conductive substrate, the surface need not be subjected to any processes, or may be subjected to a process such as mirror-surface cutting, etching, anodic oxidation, rough cutting, centerless grinding, sand blasting, or wet honing in advance.

Undercoat Layer

The undercoat layer includes, for example, a binder resin and metal oxide particles.

In particular, from the viewpoint of making the work function of the undercoat layer itself and the difference between the work functions of the undercoat layer and the charge generation layer fall within the above-described ranges, it is preferable that the undercoat layer include an electron-accepting compound in addition to the binder resin and the metal oxide particles. Optionally, the undercoat layer may include other additives.

As the binder resin, a well-known resin is used, and examples thereof include well-known polymer resin compounds (for example, acetal resin (such as polyvinyl butyral), polyvinyl alcohol resins, casein, polyamide resins, cellulose resins, gelatins, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resin, phenol resins, phenol-formaldehyde resins, melamine resin, urethane resins, unsaturated polyester resins, alkyd resins, and epoxy resins); charge transport resins having a charge transport group; and conductive resins (for example, polyaniline).

Among these, as the binder resin, resins which are insoluble in a coating solvent of the upper layer (charge generation layer) are preferable. In particular, resins obtained by a reaction of a curing agent and at least one kind of resin selected from a group consisting of thermosetting resins such as phenol resins, phenol-formaldehyde resins, melamine resins, urethane resins, unsaturated polyester resins, alkyd resins, and epoxy resins; polyamide resins; polyester resins; polyether resins; acrylic resins; polyvinyl alcohol resins; and polyvinyl acetal resins, are preferable.

As the metal oxide particles, for example, metal oxide particles with a powder resistance (volume resistivity) of from $10^2$ Ω·cm to $10^{11}$ Ω·cm may be used, and specific examples thereof include particles of tin oxide, titanium oxide, zinc oxide, and zirconium oxide.

Among these, from the viewpoint of making the work function of the undercoat layer itself and the difference between the work functions of the undercoat layer and the charge generation layer fall within the above-described ranges, particles of zinc oxide, titanium oxide, tin oxide, and indium oxide are preferable as the metal oxide particles.

The surfaces of the metal oxide particles may be treated, and two or more kinds of metal oxide particles subjected to different kinds of surface treatments or having different particle sizes may be used in combination.

The volume average particle diameter of the metal oxide particles is from 50 nm to 500 nm (preferably from 60 nm to 1,000 nm).

It is preferable that the specific surface area (BET specific surface area) of the metal oxide particles be greater than or equal to 10 $m^2/g$.

The content of the metal oxide particles is, for example, preferably from 10% by weight to 80% by weight and more preferably from 40% by weight to 80% by weight, with respect to the binder resin.

By making the content of the metal oxide particles fall within the above-described range, the work function of the undercoat layer itself and the difference between the work functions of the undercoat layer and the charge generation layer are easily set in the above-described ranges.

As the electron-accepting compound, electron transport materials such as quinone compounds (for example, chloranil and bromanil), tetracyanoquinodimethane compounds, fluorenone compounds (for example, 2,4,7-trinitrofluorenone and 2,4,5,7-tetranitro-9-fluorenone), oxadiazole compounds (for example, 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)1,3,4-oxadiazole), xanthone compounds, thiophene compounds, and diphenoquinone compounds (for example, 3,3',5,5'-tetra-t-butyldiphenoquinone) are preferable and compounds having an anthraquinone structure are particularly preferable.

As the compounds having an anthraquinone structure, for example, hydroxyanthraquinone compounds, aminoanthraquinone compounds, aminohydroxyanthraquinone compounds, and acceptor compounds having an anthraquinone structure are preferable, and specific examples thereof include anthraquinone, alizarin, quinizarin, anthrarufin, and purpurin.

Among these, from the viewpoint of making the work function of the undercoat layer itself and the difference between the work functions of the undercoat layer and the charge generation layer fall within the above-described ranges, it is preferable that the electron-accepting compound be an anthraquinone derivative.

The electron-accepting compound may be included in the undercoat layer in a state of being dispersed separately from the metal oxide particles or in a state of being attached onto the surfaces of the metal oxide particles.

Examples of a method of attaching the electron-accepting compound onto the surfaces of the metal oxide particles include a dry method and a wet method.

For example, when the electron-accepting compound is attached onto the surfaces of the metal oxide particles according to the dry method, the acceptor compound is added dropwise directly or after being dissolved in an organic solvent or is sprayed along with dry air or nitrogen gas while shearing force is applied to the metal oxide particles by stirring or the like. It is preferable that adding dropwise or spraying be performed at a temperature lower than or equal to the boiling temperature of the solvent. After adding dropwise or spraying, baking may follow at 100° C. or higher.

On the other hand, when the electron-accepting compound is attached onto the surfaces of the metal oxide particles according to the wet method, the electron-accepting compound is added while the metal oxide particles are dispersed in a solvent by, for example, stirring, ultrasonic waves, a sand mill, an attritor, or a ball mill and the solvent is removed. The solvent is removed by filtration or distillation. After the solvent is removed, baking may follow at 100° C. or higher.

The content of the electron-accepting compound is, for example, preferably from 0.01% by weight to 20% by weight, more preferably from 0.1% by weight to 10% by weight, and still more preferably from 0.5% by weight to 5% by weight, with respect to the metal oxide particles.

By making the content of the electron-accepting compound fall within the above-described range, the work function of the undercoat layer itself and the difference between the work functions of the undercoat layer and the charge generation layer are easily set in the above-described ranges.

Examples of other additives include well-known materials such as electron transport pigments (for example, condensed polycyclic pigments and azo pigments), zirconium chelate compounds, titanium chelate compounds, aluminum chelate compounds, titanium alkoxide compounds, organic titanium compounds, and silane coupling agents. In particular, the silane coupling agent is used for the surface treatment of the metal oxide particles, but may be further added to the undercoat layer as an additive.

Specific examples of the silane coupling agent include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane.

Examples of the zirconium chelate compounds include zirconium butoxide, ethyl acetoacetate zirconium, zirconium triethanolamine, acetylacetonate zirconium butoxide, zirconium ethyl acetoacetate butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

When the undercoat layer is formed, an undercoat-layer-forming coating solution in which the above-described components are added to a solvent is used.

In addition, examples of a method used for dispersing particles in the undercoat-layer-forming coating solution includes methods using medium dispersers such as a ball mill, a vibration ball mill, an attritor, a sand mill, and a horizontal sand mill; and mediumless dispersers such as a stirrer, an ultrasonic disperser, a roll mill, or a high-pressure homogenizer. Examples of the high-pressure homogenizer include a collision type dispersing a dispersion in high-pressure state through liquid-liquid collision or liquid-wall collision; and a pass-through type dispersing a dispersion by causing it to pass through a fine flow path in a high-pressure state.

Examples of a method of coating the undercoat-layer-forming coating solution on the conductive substrate include a dip coating method, a push-up coating method, a wire-bar coating method, a spray coating method, a blade coating method, a knife coating method, and a curtain coating method.

The thickness of the undercoat layer is preferably greater than or equal to 15 μm, more preferably from 15 μm to 50 μm, and still more preferably from 20 μm to 50 μm.

Charge Generation Layer

The charge generation layer includes, for example, a binder resin and a charge generation material.

Examples of the charge generation material include well-known charge generation materials such as organic pigments and inorganic pigments.

Examples of the organic pigments include azo pigments (for example, bisazo and trisazo), condensed aromatic pigments (for example, dibromoanthanthrone), perylene pigments, pyrrolopyrrole pigments, and phthalocyanine pigments.

Examples of the inorganic pigments include trigonal selenium and zinc oxide.

As the charge generation material, when exposure light having a wavelength of from 380 nm to 500 nm is used, inorganic pigments are preferable, and when exposure light having a wavelength of from 700 nm to 800 nm is used, metal phthalocyanine pigments and metal-free phthalocyanine pigments are preferable.

In particular, as the phthalocyanine pigments, hydroxygallium phthalocyanines disclosed in JP-A-5-263007 and JP-A-5-279591; chlorogallium phthalocyanine disclosed in JP-A-5-98181; dichlorotin phthalocyanines disclosed in JP-A-5-140472 and JP-A-5-140473; and titanyl phthalocyanines disclosed in JP-A-4-189873 and JP-A-5-43813 are preferable.

Among these, from the viewpoint of making the difference between the work functions of the undercoat layer and the charge generation layer, it is preferable that the charge generation material be hydroxygallium phthalocyanine or chlorogallium phthalocyanine.

Examples of the binder resin includes bisphenol A or bisphenol Z polycarbonate resins, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinyl chloride-acrylonitrile copolymer resins, vinylidene chloride-vinyl acetate-maleic anhydride resins, silicone resins, phenol-formaldehyde resins, polyacrylamide resins, polyamide resins, and poly-N-vinylcarbazole resins. As the binder resin, these examples may be used alone or in a combination of two or more kinds.

Among these, from the viewpoint of making the difference between the work functions of the undercoat layer and the charge generation layer fall within the above-described range, it is preferable that the binder resin be polyvinyl butyral resin.

In addition, the mixing ratio (in terms of weight) of the charge generation material and the binder resin is, for example, preferably in the range of 10:1 to 1:10, more preferably in the range of 75:25 to 25:75, and still more preferably in the range of 65:35 to 35:65.

When the charge generation layer is formed, a charge-generation-layer-forming coating solution in which the above-described components are added to a solvent is used.

In addition, examples of a method used for dispersing particles (for example, the charge generation material) in the charge-generation-layer-forming coating solution includes methods using medium dispersers such as a ball mill, a vibration ball mill, an attritor, a sand mill, and a horizontal sand mill; and mediumless dispersers such as a stirrer, an ultrasonic disperser, a roll mill, or a high-pressure homogenizer. Examples of the high-pressure homogenizer include a collision type dispersing a dispersion in high-pressure state through liquid-liquid collision or liquid-wall collision; and a pass-through type dispersing a dispersion by causing it to pass through a fine flow path in a high-pressure state.

Examples of a method of coating the charge-generation-layer-forming coating solution on the undercoat layer include a dip coating method, a push-up coating method, a wire-bar coating method, a spray coating method, a blade coating method, a knife coating method, and a curtain coating method.

The thickness of the charge generation layer is preferably from 0.01 μm to 5 μm and more preferably from 0.05 μm to 2.0 μm Charge Transport Layer The charge transport layer includes a charge transport material and a binder resin.

The charge transport layer may include, for example, a polymer charge transport material.

Examples of the charge transport material include well-known materials such as electron transport compounds and hole transport compounds.

Examples of the electron transport compounds include quinone compounds (such as p-benzoquinone, chloranil, bromanil, and anthraquinone)tetracyanoquinodimethane compounds, fluorenone compounds (for example, 2,4,7-trinitrofluorenone), xanthone compounds, benzophenone compounds, cyanovinyl compounds, and ethylene compounds.

Examples of the hole transport compounds include triarylamine compounds, benzidine compounds, arylalkane compounds, aryl-substituted ethylene compounds, stilbene compounds, anthracene compounds, or hydrazone compounds.

As the charge transport material, these examples may be used alone or in a combination of two or more kinds.

From the viewpoint of mobility, it is particularly preferable that the charge transport material be represented by the following structure.

(B-1)

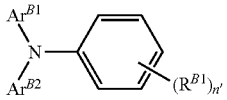

In Structural formula (B-1), $R^{B1}$ represents a methyl group and n' represents 1 or 2. In addition, $Ar^{B1}$ and $Ar^{B2}$ represent a substituted or unsubstituted aryl group and substituents thereof are represented by a halogen atom, an alkyl group having from 1 to 5 carbon atoms, an alkoxy group having from 1 to 5 carbon atoms, or a substituted amino group which is substituted with an alkyl group having from 1 to 3 carbon atoms.

(B-2)

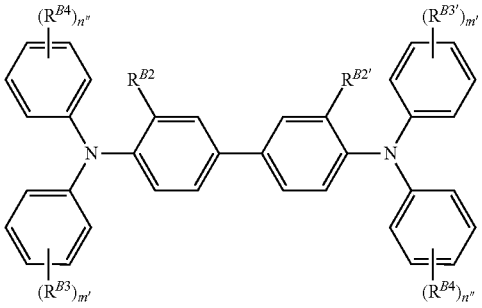

In Structural formula (B-2), $R^{B2}$ and $R^{B2'}$ each independently represent a hydrogen atom, a halogen atom, an alkyl group having from 1 to 5 carbon atoms, or an alkoxy group having from 1 to 5 carbon atoms. $R^{B3}$, $R^{B3'}$, $R^{B4}$, and $R^{B4'}$ each independently represent a halogen atom, an alkyl group having from 1 to 5 carbon atoms, an alkoxy group having from 1 to 5 carbon atoms, an amino group which is substituted with an alkyl group having 1 or 2 carbon atoms, a substituted or unsubstituted aryl group, or $—C(R^{B5})=C(R^{B6})(R^{B7})$ wherein $R^{B5}$, $R^{B6}$, and $R^{B7}$ represent a hydrogen atom, a substituted or unsubstituted alkyl group, or a substituted or unsubstituted aryl group. In addition, m' and n" represent an integer of from 0 to 2.

(B-3)

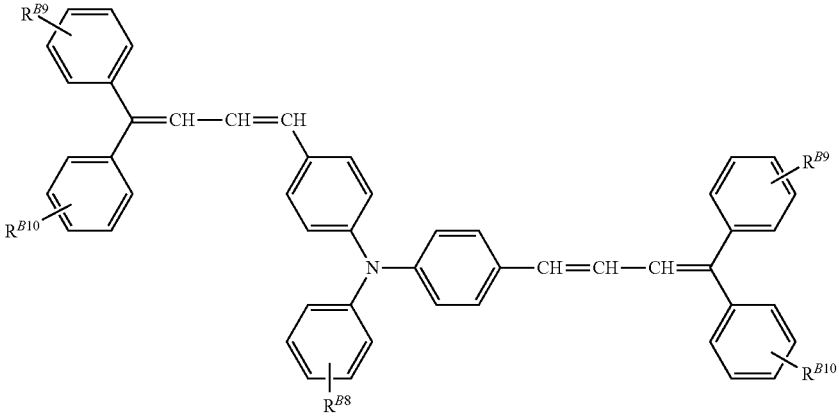

In Structural formula (B-3), $R^{B8}$ represents a hydrogen atom, an alkyl group having from 1 to 5 carbon atoms, an alkoxy group having from 1 to 5 carbon atoms, a substituted or unsubstituted aryl group, or —CH═CH—CH═C($Ar^{B3}$)$_2$. $Ar^{B3}$ represents a substituted or unsubstituted aryl group. $R^{B9}$ and $R^{B10}$ each independently represent a hydrogen atom, a halogen atom, an alkyl group having from 1 to 5 carbon atoms, an alkoxy group having from 1 to 5 carbon atoms, an amino group which is substituted with an alkyl group having 1 or 2 carbon atoms, or a substituted or unsubstituted aryl group.

Examples of the binder resin include polycarbonate resins, polyester resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinyl carbazole, and polysilane. In addition, examples of the binder resin include polyester polymer charge transport materials disclosed in JP-A-8-176293 and JP-A-8-208820. As the binder resin, these examples may be used alone or in a combination of two or more kinds.

In addition, it is preferable that the mixing ratio (in terms of weight) of the charge transport material and the binder resin be, for example, from 10:1 to 1:5.

Examples of the polymer charge transport material include well-known materials having a charge transport property such as poly-N-vinylcarbazole and polysilane.

In particular, as the polymer charge transport material, polyester polymer charge transport materials disclosed in JP-A-8-176293 and JP-A-8-208820 have a high charge transport property and thus are particularly preferable. The charge transport layer may be formed using the polymer charge transport material alone or a mixture of the polymer charge transport material and the binder resin.

The charge transport layer may be formed using, for example, a charge-transport-layer-forming coating solution in which the above-described components are added to a solvent.

Examples of a method of coating the charge-transport-layer-forming coating solution on the charge generation layer include well-known methods such as a dip coating method, a push-up coating method, a wire-bar coating method, a spray coating method, a blade coating method, a knife coating method, and a curtain coating method.

The thickness of the charge transport layer is set in a range of preferably from 5 μm to 50 μm, more preferably from 10 μm to 40 μm, and still more preferably from 10 μm to 30 μl.

Protective Layer

The protective layer is, for example, a curable layer formed of a composition containing a reactive charge transport material. That is, the protective layer is a curable layer having a charge transport property which contains a polymer (or a cross-linking substance) of reactive charge transport materials.

In addition, the protective layer may be a curable layer formed of a composition which further includes at least one kind selected from guanamine compounds and melamine compounds, from the viewpoints of improving mechanical strength and increasing the lifetime of the electrophotographic photoreceptor. That is, the protective layer may be a curable layer having a charge transport property which includes a polymer (cross-linking substance) of the reactive charge transport material and at least one kind selected from guanamine compounds and melamine compounds; and an antioxidant.

The reactive charge transport material will be described.

Examples of the reactive charge transport material include reactive charge transport materials having —OH, —$OCH_3$, —$NH_2$, —SH, —COOH or the like as a reactive functional group.

It is preferable that the reactive charge transport material be a charge transport material having at least two (or furthermore three) of the reactive functional groups. In this way, when the charge transport material includes more of the reactive functional groups, the crosslink density increases and a curable layer (cross-linked layer) with a higher strength may be obtained.

It is preferable that the reactive charge transport material be a compound represented by Formula (I) below, from the viewpoint of suppressing the abrasion of a foreign substance removal member or the abrasion of an electrophotographic photoreceptor.

$$F—((—R^{14}—X)_{n1}(R^{15})_{n2}—Y)_{n3} \quad (I)$$

In Formula (I), F represents an organic group (charge transport structure) derived from a compound having a charge transport capability; $R^{14}$ and $R^{15}$ each independently represent a linear or branched alkylene group having from 1 to 5 carbon atoms; n1 represents 0 or 1; n2 represents 0 or 1; and n3 represents an integer of from 1 to 4. X represents an oxygen atom, NH, or a sulfur atom and Y represents a reactive functional group.

In Formula (I), as the compound having a charge transport capability of "the organic group derived from a compound having a charge transport capability" represented by F, for example, arylamine derivatives are preferable. Examples of the arylamine derivatives include triphenylamine derivatives and tetraphenylbenzidine derivatives.

It is preferable that the compound represented by Formula (I) be a compound represented by Formula (II) below. The compound represented by Formula (II) is particularly superior in terms of charge mobility, stability to, for example, oxidation, and the like.

(II)

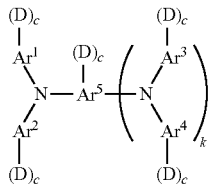

In Formula (II), $Ar^1$ to $Ar^4$ may be the same or different from each other and each independently represent a substituted or unsubstituted aryl group; $Ar^5$ represents a substituted or unsubstituted aryl group or a substituted or unsubstituted arylene group; D represents —(—$R^{14}$—X)$_{n1}$($R^{15}$)$_{n2}$—Y; "c"s each independently represent 0 or 1; k represents 0 or 1; and the total number of "D"s is from 1 to 4. In addition, $R^{14}$ and $R^{15}$ each independently represent a linear or branched alkylene group having from 1 to 5 carbon atoms; n1 represents 0 or 1; n2 represents 0 or 1; X represents an oxygen atom, NH, or a sulfur atom; and Y represents a reactive functional group.

Here, examples of a substituent of the substituted aryl group and the substituted arylene group other than D include an alkyl group having from 1 to 4 carbon atoms, an alkoxy group having from 1 to 4 carbon atoms, and a substituted or unsubstituted aryl group having from 6 to 10 carbon atoms.

In Formula (I1), "—(—$R^{14}$—X)$_{n1}$($R^{15}$)$_{n2}$—Y" represented by D is the same as that of Formula (I), $R^{14}$ and $R^{15}$ each independently represents a linear or branched alkylene group having from 1 to 5 carbon atoms. In addition, it is preferable that n1 represent 1. In addition, it is preferable that n2 represent 1. In addition, it is preferable that X represent an oxygen atom.

In Formula (II), the total number of "D"s corresponds to n3 in the Formula (I), which is preferably from 2 to 4 and more preferably 3 or 4.

In addition, in Formulae (I) and (II), when the total number of "D"s is from 2 to 4 and preferably 3 or 4 in a single molecule, the crosslink density increases and a cross-linked layer with a higher strength may be obtained. In particular, when a blade member for removing foreign substances is used, the rotation torque of an electrophotographic photoreceptor is reduced. As a result, the abrasion of the blade member and the electrophotographic photoreceptor may be suppressed. The details are not clear, but it is presumed that, as described above, by increasing the number of the reactive functional groups, a curable layer with higher crosslink density may be obtained, the molecular motion on the outermost surface of an electrophotographic photoreceptor is suppressed, and the interaction with surface molecules of the blade member is weakened.

In Formula (II), it is preferable that $Ar^1$, $Ar^2$, $Ar^3$, and $Ar^4$ represent any one of compounds represented by Formulae (1) to (7) below. In Formulae (1) to (7) below, "-(D)$_c$"s which may be respectively linked to the $Ar^1$ to $Ar^4$, are also shown.

(1)

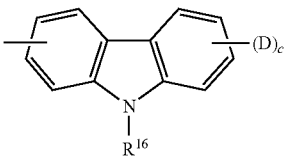

(2)

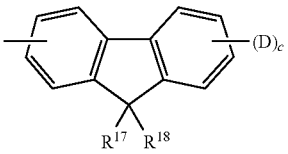

(3)

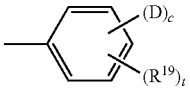

(4)

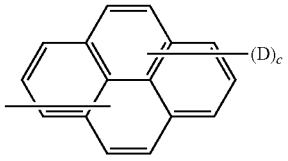

-continued (5)

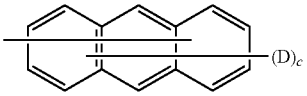

(6)

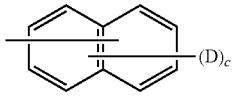

(7)

In Formulae (1) to (7), $R^{16}$ represents one kind selected from a group consisting of a hydrogen atom, an alkyl group having from 1 to 4 carbon atoms, a phenyl group which is substituted with an alkyl group having from 1 to 4 carbon atoms or an alkoxy group having from 1 to 4 carbon atoms, an unsubstituted phenyl group, and an aralkyl group having from 7 to 10 carbon atoms; $R^{17}$ and $R^{18}$ each independently represents one kind selected from a group consisting of a hydrogen atom, an alkyl group having from 1 to 4 carbon atoms, an alkoxy group having from 1 to 4 carbon atoms, a phenyl group which is substituted with an alkoxy group having from 1 to 4 carbon atoms, an unsubstituted phenyl group, an aralkyl group having from 7 to 10 carbon atoms, and a halogen atom; $R^{19}$ represents one kind selected from a group consisting of an alkyl group having from 1 to 4 carbon atoms, an alkoxy group having from 1 to 4 carbon atoms, a phenyl group which is substituted with an alkoxy group having from 1 to 4 carbon atoms, an unsubstituted phenyl group, an aralkyl group having from 7 to 10 carbon atoms, and a halogen atom; Ar represents a substituted or unsubstituted arylene group; D and c represent the same as those represented by "D" and "c" in Formula (II); s represents 0 or 1; and t represents an integer of from 1 to 3.

In this case, it is preferable that Ar in Formula (7) be represented by Formula (8) or (9) below.

(8)

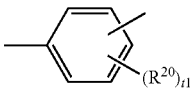

(9)

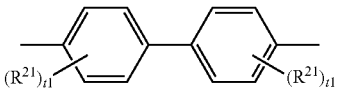

In Formulae (8) and (9), $R^{20}$ and $R^{21}$ each independently represent one kind selected from a group consisting of an alkyl group having from 1 to 4 carbon atoms, an alkoxy group having from 1 to 4 carbon atoms, a phenyl group which is substituted with an alkoxy group having from 1 to 4 carbon atoms, an unsubstituted phenyl group, an aralkyl group having from 7 to 10 carbon atoms, and a halogen atom; and t1 represents an integer of from 1 to 3.

In addition, it is preferable that Z' Formula (7) represent any one of compounds represented by Formulae (10) to (17) below.

(10

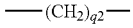

(11)

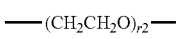

-continued (12)

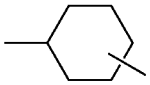

(13)

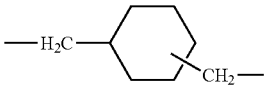

(14)

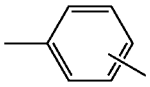

(15)

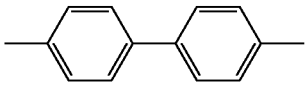

(16)

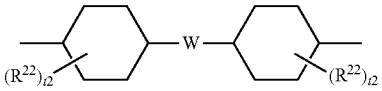

(17)

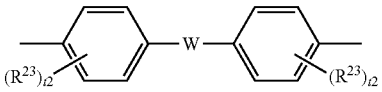

In Formulae (10) to (17), $R^{22}$ and $R^{23}$ each independently represent one kind selected from a group consisting of an alkyl group having from 1 to 4 carbon atoms, an alkoxy group having from 1 to 4 carbon atoms or a phenyl group which is substituted with an alkoxy group having from 1 to 4 carbon atoms, an unsubstituted phenyl group, an aralkyl group having from 7 to 10 carbon atoms, and a halogen atom; W represents a divalent group; q2 and r2 each independently represent an integer of from 1 to 10; and "t2"s each independently represent an integer of from 1 to 3.

It is preferable that W in Formulae (16) and (17) represent any one of divalent groups represented by Formulae (18) to (26) below. In this case, in Formula (25), u represents an integer of from 0 to 3.

(18)

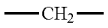

(19)

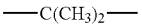

(20)

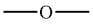

(21)

(22)

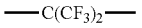

(23)

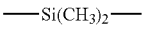

(24)

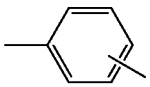

(25)

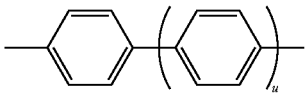

-continued (26)

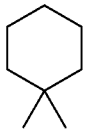

In Formula (II), it is preferable that, when k is 0, $Ar^5$ represents any one of aryl groups represented by Formulae (1) to (7), which is used as an example in the description of $Ar^1$ to $Ar^4$; and when k is 1, $Ar^5$ represents an arylene group in which a hydrogen atom is excluded from any one of aryl groups represented by Formulae (1) to (7).

Specific examples of the compound represented by Formula (I) include compounds shown in below. The compound represented by Formula (I) is not limited to these examples.

I-1

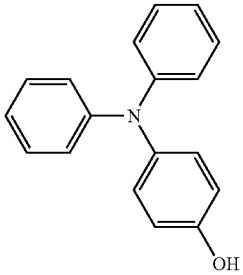

I-2

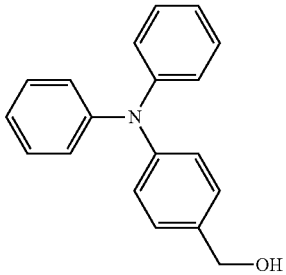

I-3

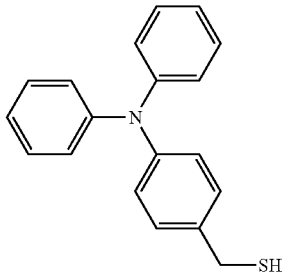

I-4

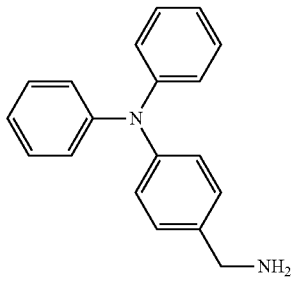

-continued
I-5
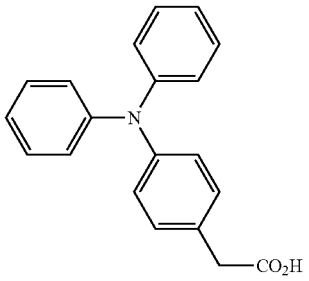
I-6
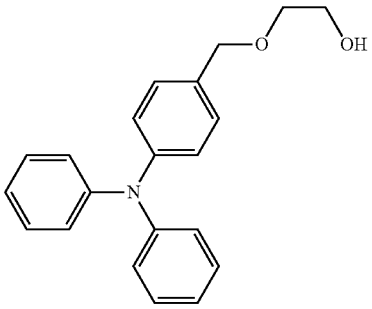
I-7
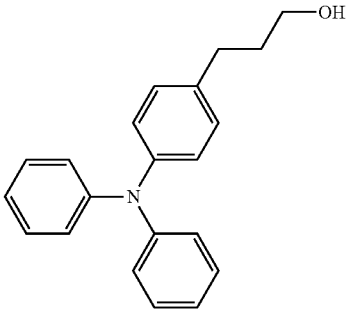
I-8
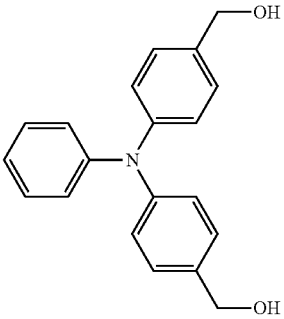
I-9
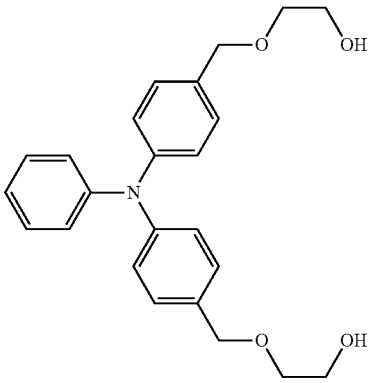
-continued
I-10
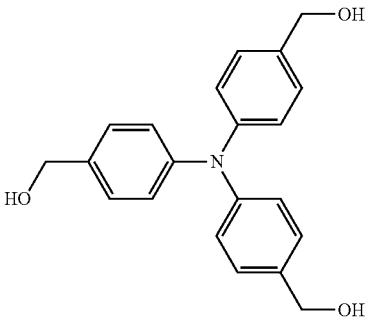
I-11
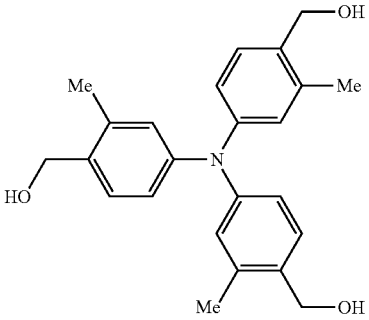
I-12
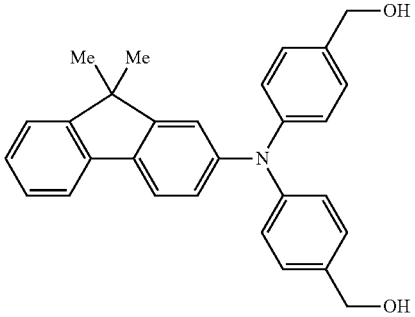
I-13
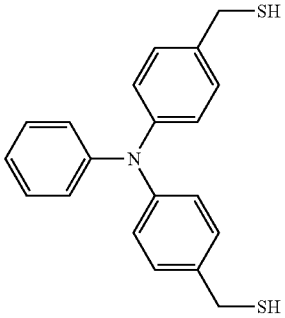
I-14
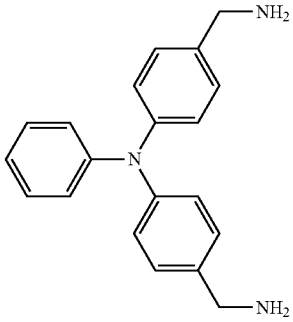

-continued
I-15
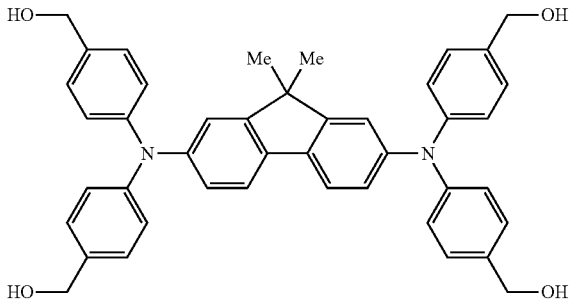
I-16
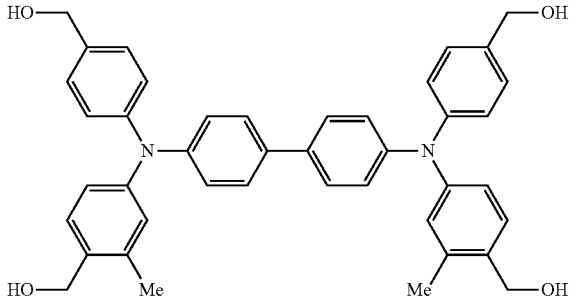
I-17
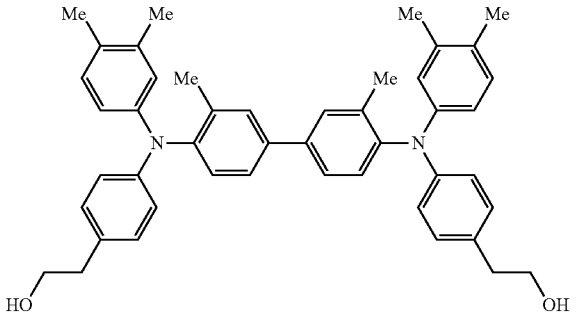
I-18
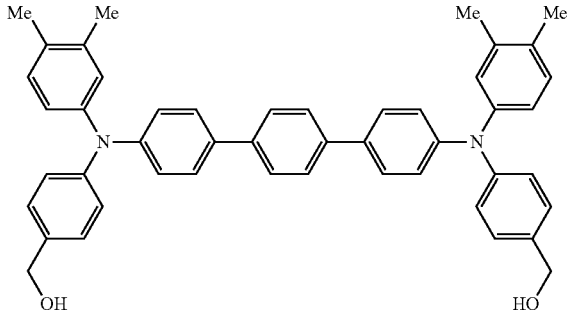
I-19
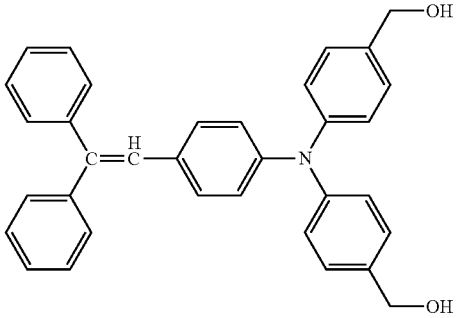
-continued
I-20
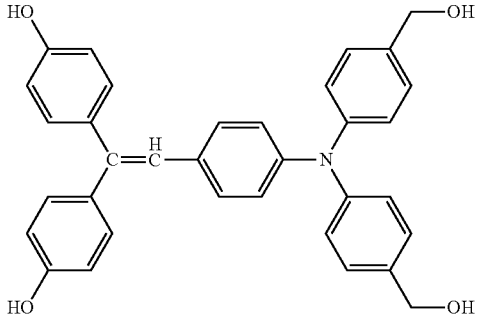
I-21
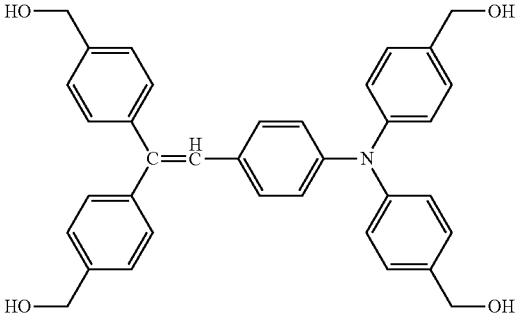
I-22
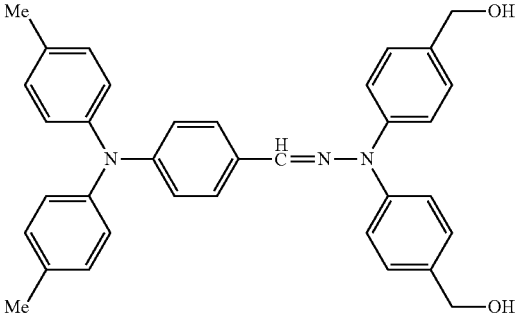
I-23
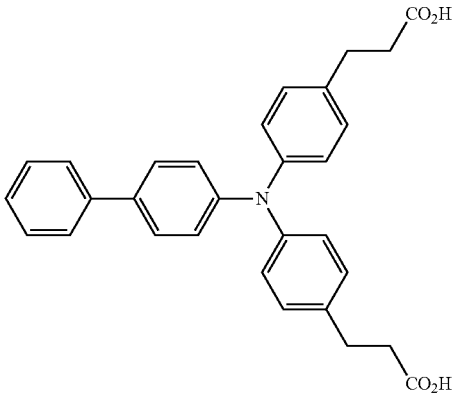

-continued
I-24
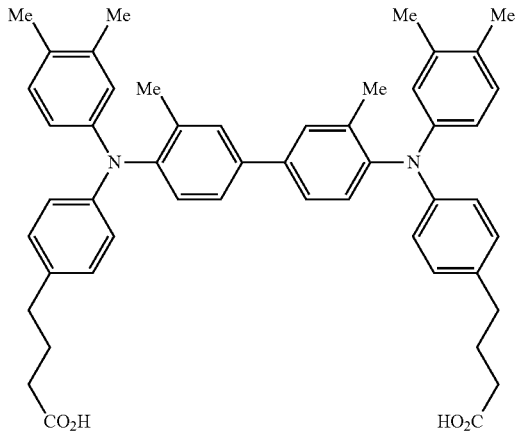
I-25
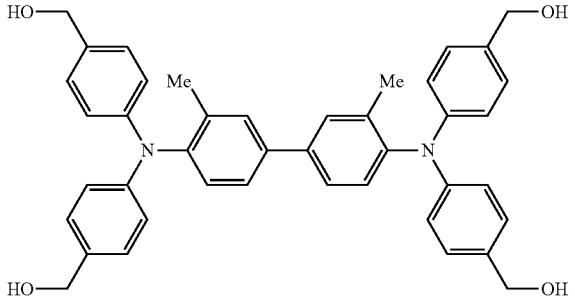
I-26
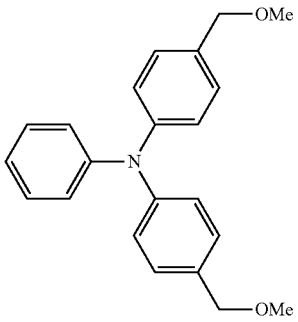
I-27
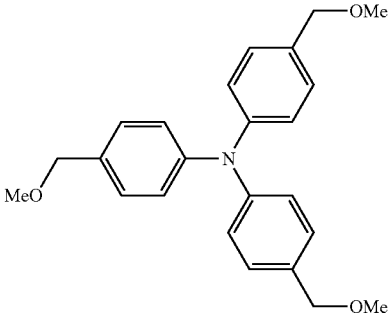
-continued
I-28
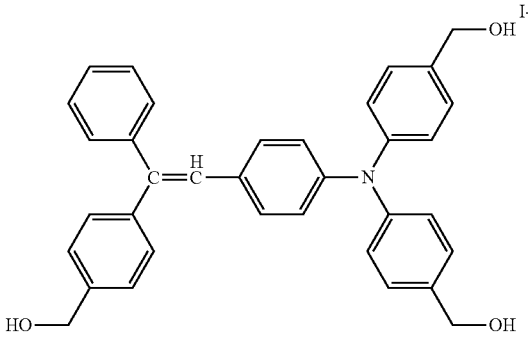
I-29
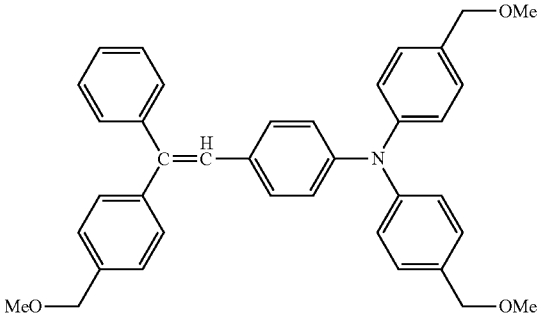
I-30
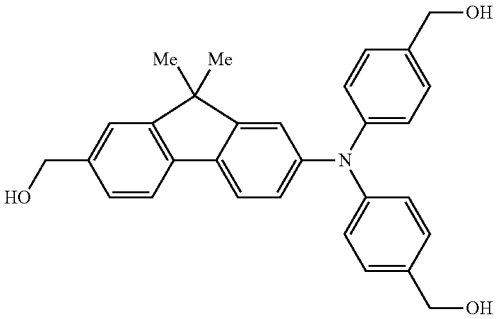
I-31
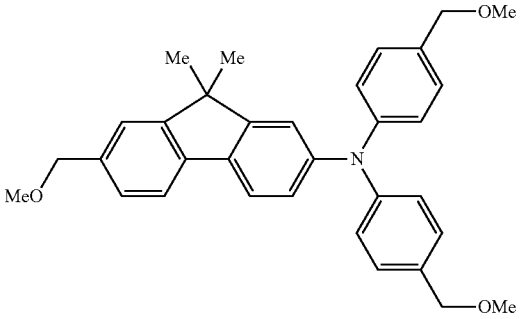
I-32
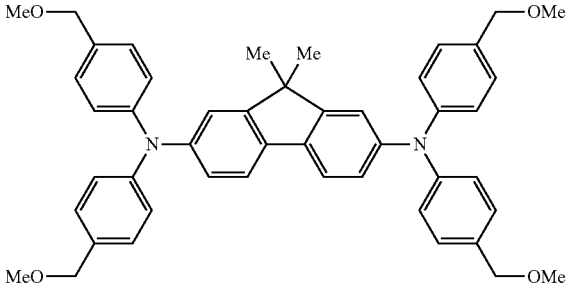

-continued

I-33

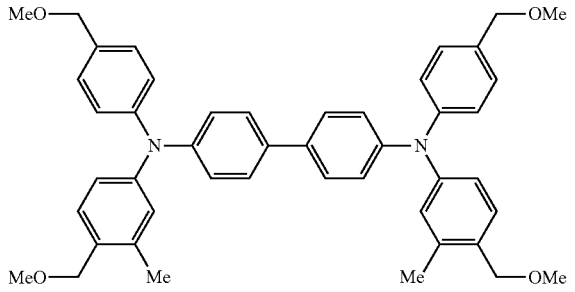

I-34

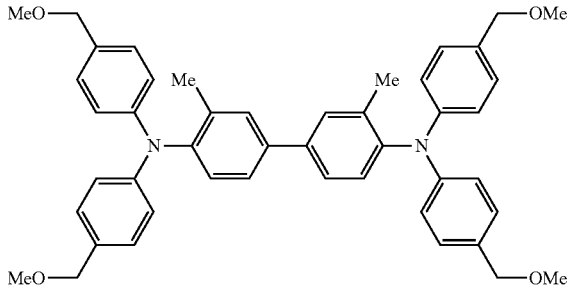

The content of the reactive charge transport material (the solid content concentration thereof in a coating solution) is, for example, preferably greater than or equal to 80% by weight, more preferably greater than or equal to 90% by weight, and still more preferably greater than or equal to 95% by weight, with respect to all of the components of the layer (in terms of solid content). When the solid content concentration is less than 90% by weight, electrical characteristics may deteriorate. The upper limit of the content of the reactive charge transport material is not limited as long as other additives function effectively and the higher upper limit is preferable.

Next, the guanamine compound will be described.

The guanamine compound is a compound having a guanamine structure, and examples thereof include acetoguanamine, benzoguanamine, formoguanamine, steroguanamine, spiroguanamine, and cyclohexylguanamine.

In particular, it is preferable that the guanamine compound be at least one kind selected from compounds represented by Formula (A) below and polymers thereof. In this case, the polymers represent oligomers obtained by polymerization of compounds represented by Formula (A) as a structural unit, and the polymerization degree thereof is, for example, from 2 to 200 (preferably from 2 to 100). As the compound represented by Formula (A), the above examples may be used alone or in a combination of two or more kinds. In particular, when being used as a mixture of two or more kinds or as a polymer (oligomer) using the mixture as a structural unit, the compound represented by Formula (A) has an improved solubility in a solvent.

Formula (A)

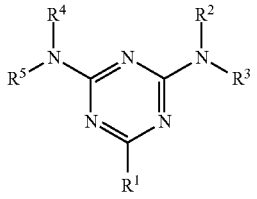

In Formula (A), $R^1$ represents a linear or branched alkyl group having from 1 to 10 carbon atoms, a substituted or unsubstituted phenyl group having from 6 to 10 carbon atoms, or a substituted or unsubstituted alicyclic hydrocarbon group having from 4 to 10 carbon atoms. $R^2$ to $R^5$ each independently represent hydrogen, —$CH_2$—OH or —$CH_2$—O—$R^6$. $R^6$ represents a linear or branched alkyl group having from 1 to 10 carbon atoms.

In Formula (A), the number of carbon atoms of the alkyl group represented by $R^1$ is preferably from 1 to 10, more preferably from 1 to 8, and still more preferably from 1 to 5. In addition, the alkyl group may be linear or branched.

In Formula (A), the number of carbon atoms of the phenyl group represented by $R^1$ is preferably from 6 to 10 and more preferably from 6 to 8. Examples of a substituent for the substituted phenyl group include a methyl group, an ethyl group, and a propyl group.

In Formula (A), the number of carbon atoms of the alicyclic hydrocarbon group represented by $R^1$ is preferably from 4 to 10 and more preferably from 5 to 8. Examples of a substituent for the substituted alicyclic hydrocarbon group include a methyl group, an ethyl group, and a propyl group.

In "—$CH_2$—O—$R^6$" represented by $R^2$ to $R^5$ of Formula (A), the number of carbon atoms of the alkyl group represented by $R^6$ is preferably from 1 to 10, more preferably from 1 to 8, and still more preferably from 1 to 6. In addition, the alkyl group may be linear or branched. Preferable examples thereof include a methyl group, an ethyl group, and a butyl group.

It is particularly preferable that the compound represented by Formula (A) be a compound in which $R^1$ represents a substituted or unsubstituted phenyl group having from 6 to 10 carbon atoms; and $R^2$ to $R^5$ each independently represent —$CH_2$—O—$R^6$. In addition, it is preferable that $R^6$ represent a methyl group or an n-butyl group.

The compound represented by Formula (A) is synthesized by using, for example, guanamine and formaldehyde according to a well-known method (for example, refer to the fourth series of Experimental Chemistry, vol. 28, p. 430).

Hereinafter, as specific examples of the compound represented by Formula (A), Exemplary Compounds (A)-1 to (A)-42 are shown, but the exemplary embodiment is not limited thereto. In addition, the following specific examples represent monomers and may be polymers (oligomers) using the monomers as a structural unit. In the following exemplary embodiment, "Me" represents a methyl group, "Bu" represents a butyl group, and "Ph" represents a phenyl group.

(A)-1
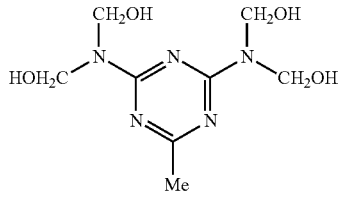
(A)-2
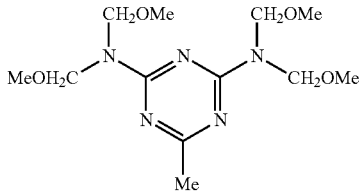
(A)-3
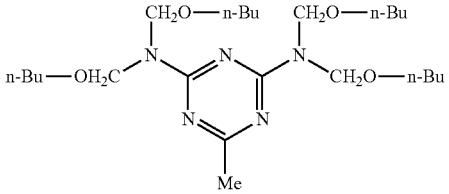
(A)-4
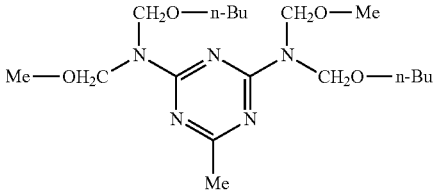
(A)-5
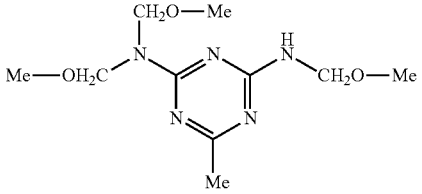
(A)-6
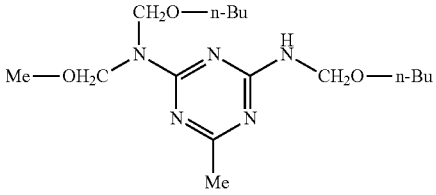
(A)-7
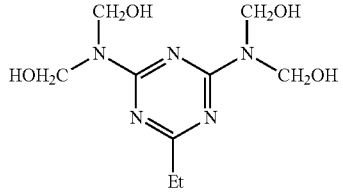
(A)-8
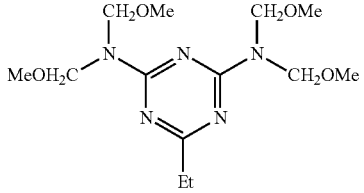
-continued
(A)-9
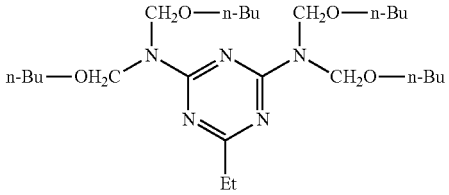
(A)-10
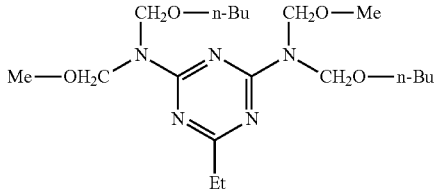
(A)-11
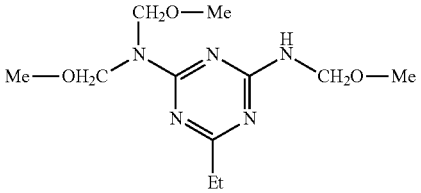
(A)-12
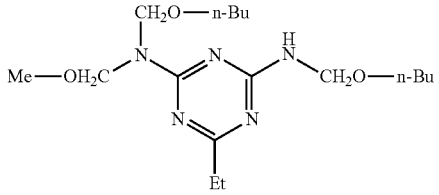
(A)-13
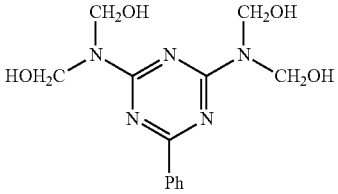
(A)-14
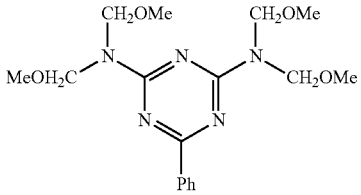
(A)-15
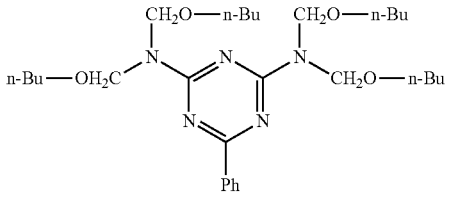
(A)-16
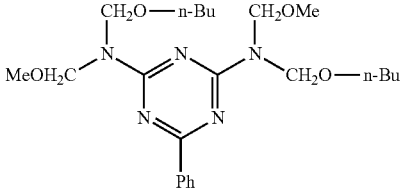

-continued
(A)-17
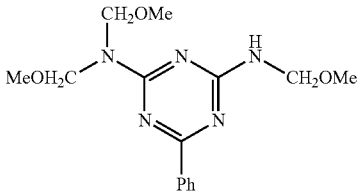
(A)-18
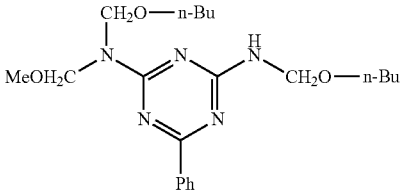
(A)-19
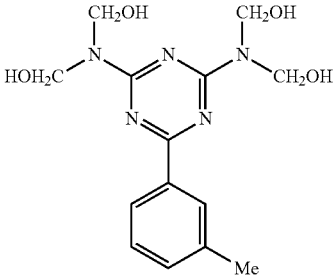
(A)-20
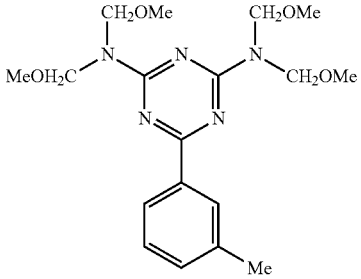
(A)-21
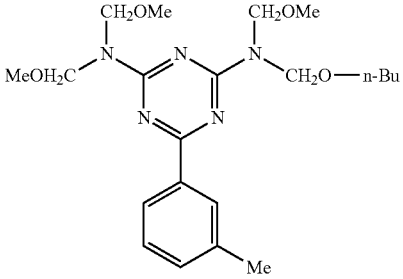
(A)-22
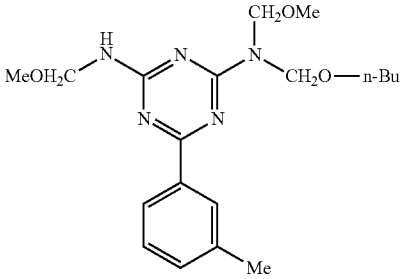
-continued
(A)-23
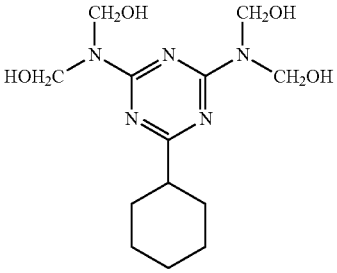
(A)-24
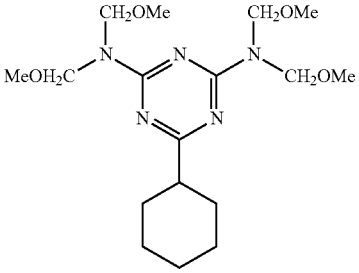
(A)-25
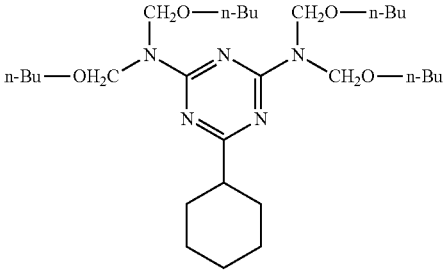
(A)-26
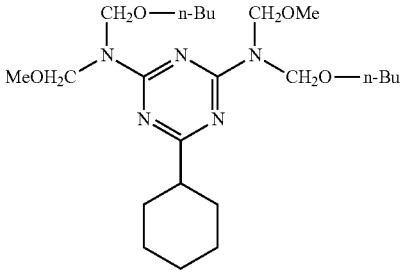
(A)-27
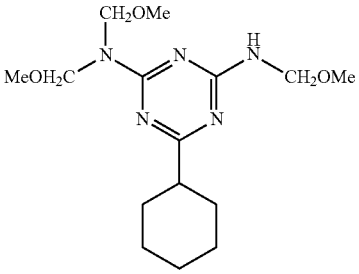

-continued
(A)-28
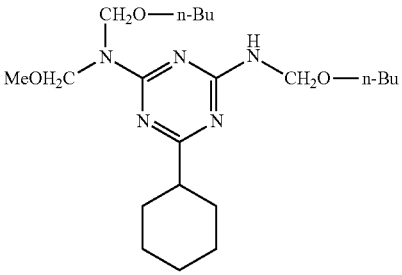
(A)-29
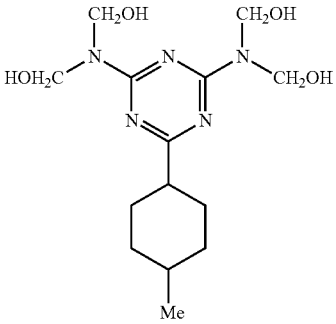
(A)-30
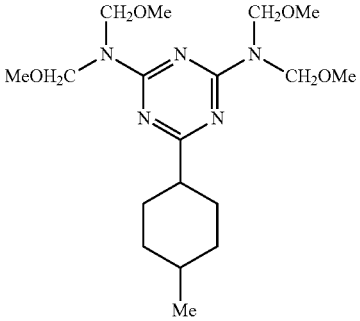
(A)-31
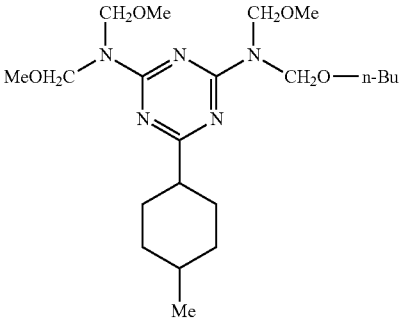
(A)-32
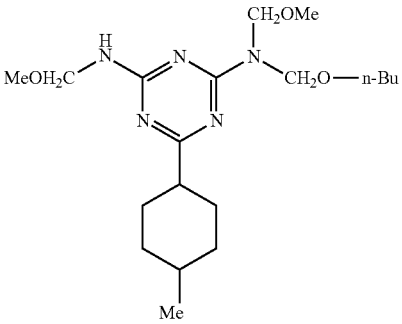
-continued
(A)-33
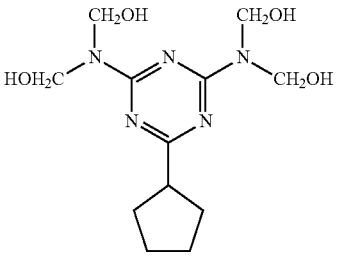
(A)-34
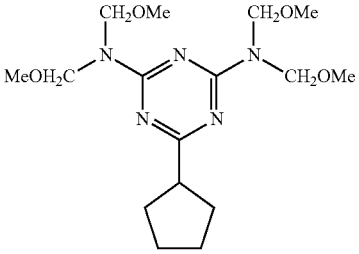
(A)-35
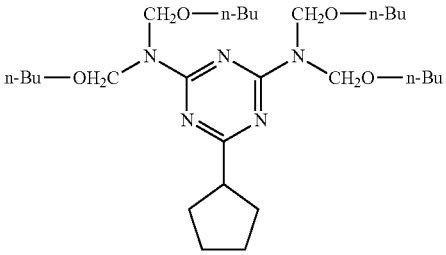
(A)-36
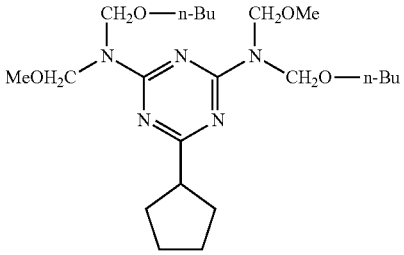
(A)-37
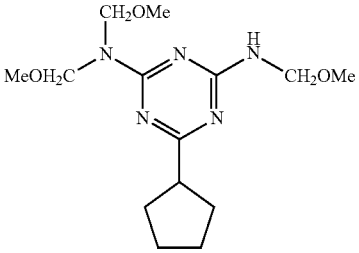
(A)-38
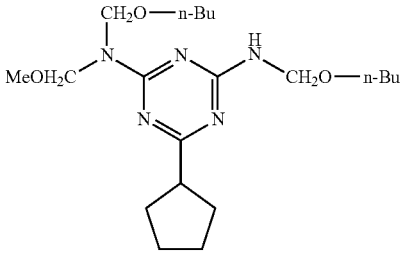

-continued (A)-39

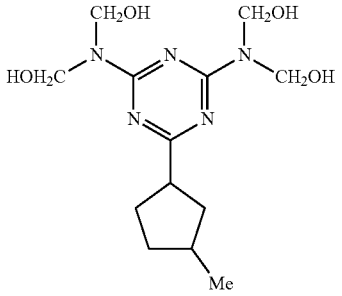

(A)-40

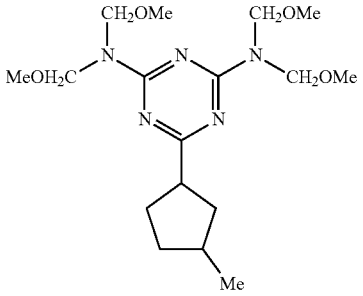

(A)-41

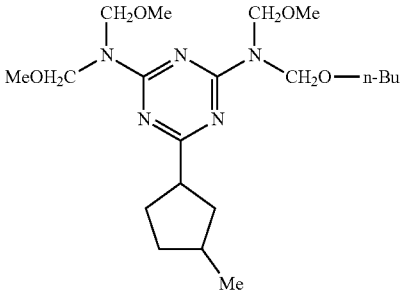

(A)-42

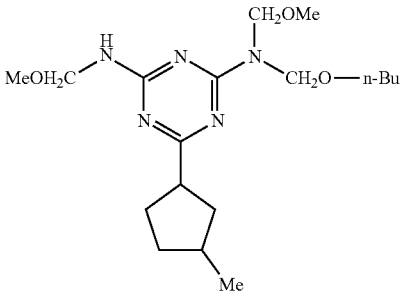

Examples of commercially available products of the compound represented by Formula (A) include SUPER BECKAMINE (R) L-148-55, SUPER BECKAMINE (R) 13-535, SUPER BECKAMINE (R) L-145-60, and SUPER BECKAMINE (R) TD-126 (all of which are manufactured by DIC Corporation); and NIKALAC BL-60 and NIKALAC BX-4000 (both of which are manufactured by NIPPON CARBIDE INDUSTRIES CO., INC.).

In addition, after synthesizing the compound (including polymers) represented by Formula (A) or purchasing a commercially available product thereof, in order to exclude the effect of a residual catalyst, the compound may be dissolved in an appropriate solvent such as toluene, xylene, and ethyl acetate and washed with distilled water, ion exchange water, or the like; and may be treated with ion exchange resin.

Next, the melamine compound will be described.

It is preferable that the melamine compound has a melamine structure and, in particular, be at least one kind selected from compounds represented by Formula (B) below and polymers thereof. In this case, similarly to the case of Formula (A), the polymers represent oligomers obtained by polymerization of compounds represented by Formula (B) as a structural unit, and the polymerization degree thereof is, for example, from 2 to 200 (preferably from 2 to 100). As the compound represented by Formula (B) or the polymer thereof, the above examples may be used alone or in a combination of two or more kinds. The compound represented by Formula (B) or the polymer thereof may be used in combination with the compound represented by Formula (A) or the polymer thereof. In particular, when being used as a mixture of two or more kinds or as a polymer (oligomer) using the compound as a structural unit, the compound represented by Formula (B) has an improved solubility in a solvent.

Formula (B)

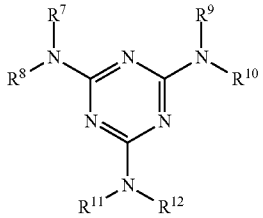

In Formula (B), $R^7$ to $R^{12}$ each independently represent a hydrogen atom, —$CH_2$—OH, —$CH_2$—O—$R^{13}$, and —O—$R^{13}$; and $R^{13}$ represents an alkyl group having from 1 to 5 carbon atoms which may be branched. Examples of the alkyl group include a methyl group, an ethyl group, and a butyl group.

The compound represented by Formula (B) is synthesized from, for example, melamine and formaldehyde according to a well-known method (for example, synthesized in the same method as that of melamine resin described in the fourth series of Experimental Chemistry, vol. 28, p. 430).

Hereinafter, as specific examples of the compound represented by Formula (B), Exemplary Compounds (B)-1 to (B)-8 are shown, but the exemplary embodiment is not limited thereto. In addition, the following specific examples represent monomers and may be polymers (oligomers) using the monomers as a structural unit.

(B)-1

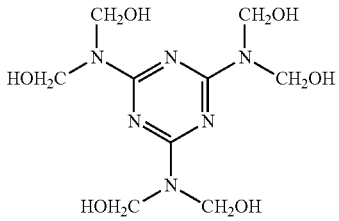

(B)-2

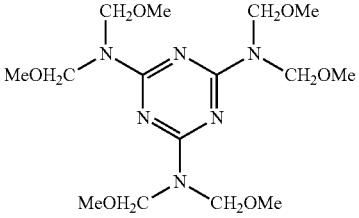

-continued (B)-3

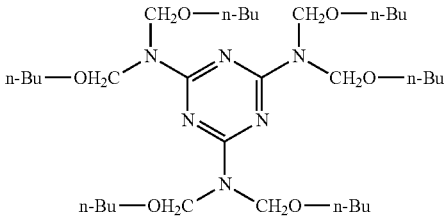

(B)-4

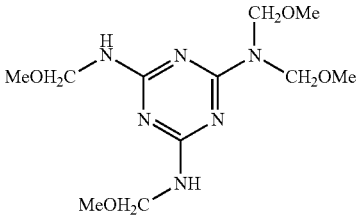

(B)-5

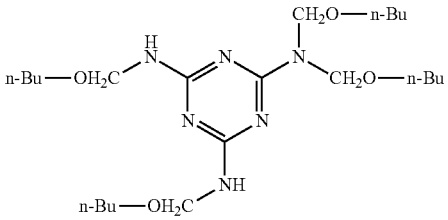

(B)-6

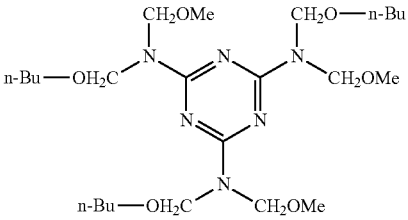

(B)-7

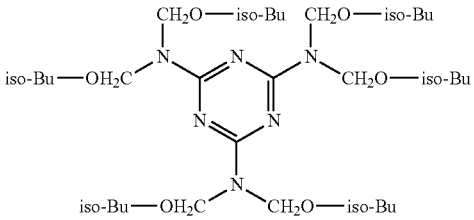

(B)-8

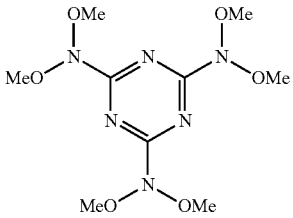

Examples of commercially available products of the compound represented by Formula (B) include SUPER-MELAMINE No. 90 (manufactured by NOF CORPORATION), SUPER BECKAMINE (R) TD-139-60 (manufactured by DIC Corporation), U-VAN 2020 (manufactured by Mitsui Chemicals Inc.), SUMITEX RESIN M-3 (manufactured by Sumitomo Chemical Co., Ltd.), and NIKALAC MW-30 (manufactured by NIPPON CARBIDE INDUSTRIES CO., INC.).

In addition, after synthesizing the compound (including polymers) represented by Formula (B) or purchasing a commercially available product thereof, in order to exclude the effect of residual catalyst, the compound may be dissolved in an appropriate solvent such as toluene, xylene, and ethyl acetate and washed with distilled water, ion exchange water, or the like; or may be treated with ion exchange resin.

In this case, the content (the solid content concentration in a coating solution) of at least one kind selected from the guanamine compound (compound represented by Formula (A)) and the melamine compound (compound represented by Formula (B)) is from 0.1% by weight to 5% by weight and more preferably from 1% by weight to 3% by weight, with respect to all of the components of the layer (in terms of solid content). When the solid content concentration is less than 0.1% by weight, it is difficult for a layer to be dense and thus difficult to obtain sufficient strength, and when the solid content concentration is greater than 5% by weight, electrical characteristics and resistance to a ghost (unevenness in density caused by exposure history) may deteriorate.

Hereinafter, the protective layer will be described in further detail.

In the protective layer, the reactive charge transport material (for example, the compound represented by Formula (I)) may be used in combination with a phenol resin, a urea resin, an alkyd resin, or the like. In addition, in order to improve strength, it is also effective that a compound having more functional groups in a single molecule such as spiroacetal guanamine resin (for example, "CTU-guanamine" (manufactured by Ajinomoto Fine Techno Co., Inc.)) be copolymerized with a material in the cross-linking substance.

In order to efficiently suppress the oxidation due to discharge produced gas, another thermo-setting resin such as phenol resin may be added and mixed into the protective layer so as not for the discharge produced gas to be excessively adsorbed to the protective layer An antioxidant may be added to the protective layer 5. As the antioxidant, for example, hindered phenol antioxidants or hindered amine antioxidants may be used, and examples thereof include well-known antioxidants such as organic sulfur antioxidants, phosphite antioxidants, dithiocarbamate antioxidants, thiourea antioxidants, and benzimidazole antioxidants.

It is preferable that a surfactant be added to the protective layer. The surfactant is not particularly limited as long as it includes fluorine atoms and at least one structure of an alkylene oxide structure and a silicone structure, but the surfactant having the plural above-described structures is preferable because the affinity to and the compatibility in a charge transport organic compound are high, the layer forming property of a protective-layer-forming coating solution is improved, and wrinkles and unevenness in the protective layer are suppressed.

In the protective layer, a coupling agent or a fluorine compound may be further used in order to adjust the forming property, the flexibility, the lubricity, the adhesion, and the like of a layer. As such a compound, various silane coupling agents and commercially available silicone hard-coating agents are used.

A resin which is soluble in alcohol may be added to the protective layer, for the purposes of resistance to discharge gas, mechanical strength, scratch resistance, particle dispersibility, viscosity control, torque reduction, wear amount control, an increase in pot life (the preservability of a layer-forming coating solution), and the like.

In this case, the resin which is soluble in alcohol indicates a resin of which 1% by weight or greater is soluble in an alcohol having from 5 or less carbon atoms. Examples of the resin which is soluble in alcohol include polyvinyl acetal resin and polyvinyl phenol resin.

Various particles may be added to the protective layer in order to lower residual potential or to improve strength. Examples of the particles include silicon-containing particles and fluororesin particles.

The silicon-containing particles include silicon atoms as a constituent element, and specific examples thereof include colloidal silica particles and silicone particles.

The fluororesin particles are not particularly limited, but examples thereof include particles of polytetrafluoroethylene, perfluoroalkoxy fluororesin, polychlorotrifluoroethylene, polyvinylidene fluoride, polydichlorodifluoroethylene, tetrafluoroethylene-perfluoroalkylvinylether copolymer, tetrafluoroethylene-hexa fluoropropylene copolymer, tetrafluoroethylene-ethylene copolymer, and tetrafluoroethylene-hexafluoropropylene-perfluoroalkylviny lether copolymer.

The fluororesin particles may be used in combination with an alkyl fluoride group-containing copolymer. Examples of commercially available products of the alkyl fluoride group-containing copolymer include GF-300 and GF-400 (manufactured by TOAGOSEI CO., LTD.); SURFLON series (manufactured by AGO SEIMI CHEMICAL CO., LTD.); FTERGENT series (manufactured by NEOS COMPANY LIMITED); PF series (manufactured by KITAMURA CHEMICALS CO., LTD.); MEGAFAC series (manufactured by DIC Corporation); and FC series (manufactured by 3M Company).

For the same purpose, oil such as silicone oil may be added to the protective layer.

Metal, metal oxide, carbon black, or the like may be added to the surface protective layer.

It is preferable that the protective layer is a curable layer (cross-linked layer) in which the reactive charge transport materials and optionally, at least one kind selected from the guanamine compound and the melamine compound are polymerized (cross-linked) using an acid catalyst. Examples of the acid catalyst include aliphatic carboxylic acids such as acetic acid, chloroacetic acid, trichloroacetic acid, trifluoroacetic acid, oxalic acid, maleic acid, malonic acid, and lactic acid; aromatic carboxylic acids such as benzoic acid, phthalic acid, terephthalic acid, and trimellitic acid; and aliphatic and aromatic sulfonic acids such as methanesulfonic acid, dodecylsulfonic acid, benzenesulfonic acid, dodecylbenzenesulfonic acid, and naphthalenesulfonic acid. Among these, a sulfur-containing material is preferable.

In this case, the content of the catalyst is preferably from 0.1% by weight to 50% by weight and more preferably from 10% by weight to 30% by weight, with respect to all of the components of the layer (in terms of solid content). When the content is less than the above-described range, catalytic activity may be too low, and when the content is greater than the above-described range, lightfastness may deteriorate. Lightfastness indicates a phenomenon in which, when the photosensitive layer is exposed to light emitted from the outside such as room illumination, the density of an exposed portion is reduced. The reason is not clear but it is presumed that the same phenomenon as an optical memory effect occurs, as disclosed in JP-A-5-099737.

The protective layer with the above-described configuration is formed using a protective-layer-forming coating solution into which the above-described components are mixed. The protective-layer-forming coating solution may be prepared without a solvent, and optionally, may be prepared with a solvent. As such a solvent, one kind or a mixture of two or more kinds may be used, in which the boiling point thereof is preferably less than or equal to 100° C. As the solvent, a solvent having at least one hydroxyl group (for example, alcohols) is particularly preferable.

In addition, when the coating solution is formed by a reaction of the above-described components, the components may be simply mixed and dissolved in the solvent, but may be heated at room temperature (for example, 25° C.) to 100° C. and preferably 30° C. to 80° C. for 10 minutes to 100 hours and preferably 1 hour to 50 hours. In addition, at this time, it is preferable that ultrasonic waves be applied thereto. As a result, a partial reaction may advance and thus a layer with less defects and less unevenness in thickness may be obtained.

The protective-layer-forming coating solution is coated according to a well-known method such as a blade coating method, a wire-bar coating method, a spray coating method, a dip coating method, a bead coating method, an air knife coating method, or a curtain coating method, and optionally heated at a temperature of, for example, 100° C. to 170° C. to be cured. As a result, the protective layer is obtained.

The thickness of the protective layer is preferably from 3 μm to 40 μm, more preferably from 5 μm to 35 μm, and still more preferably from 5 μm to 15 μm.

Image Forming Apparatus and Process Cartridge

A process cartridge according to the exemplary embodiment includes the electrophotographic photoreceptor according to the exemplary embodiment; and at least one unit selected from (A) a charging unit that charges a surface of the electrophotographic photoreceptor, (B) a latent image forming unit that forms an electrostatic latent image on a charged surface of the electrophotographic photoreceptor, (C) a developing unit that develops the electrostatic latent image, which is formed on the surface of the electrophotographic photoreceptor, using toner to form a toner image, (D) a transfer unit that transfers the toner image, which is formed on the surface of the electrophotographic photoreceptor, onto a recording medium, and (E) a cleaning unit that cleans the electrophotographic photoreceptor.

Further, an image forming apparatus according to the exemplary embodiment includes the electrophotographic photoreceptor according to the exemplary embodiment; a charging unit that charges a surface of the electrophotographic photoreceptor; a latent image forming unit that forms an electrostatic latent image on a charged surface of the electrophotographic photoreceptor; a developing unit that develops the electrostatic latent image, which is formed on the surface of the electrophotographic photoreceptor, using toner to form a toner image; and a transfer unit that transfers the toner image, which is formed on the surface of the electrophotographic photoreceptor, onto a recording medium.

Figure 2:
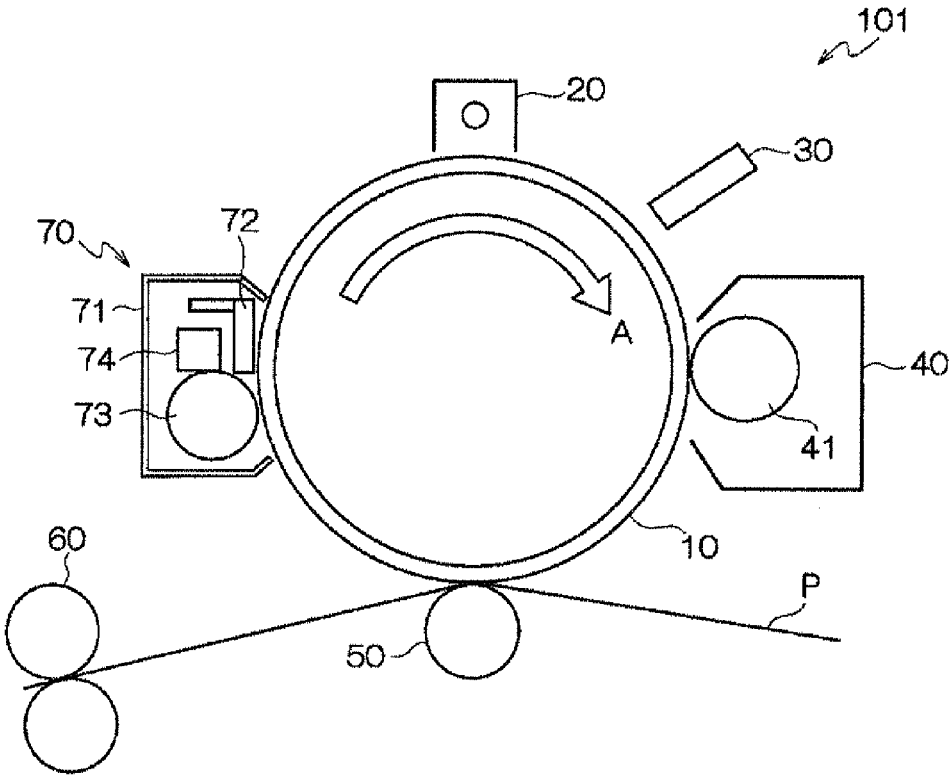
FIG. 2 is a diagram schematically illustrating a configuration of an image forming apparatus according to an exemplary embodiment of the invention.

FIG. 2 is a diagram schematically illustrating a configuration of an image forming apparatus according to the exemplary embodiment.

As illustrated in FIG. 2, an image forming apparatus 101 according to the exemplary embodiment includes an electrophotographic photoreceptor 10 that rotates clockwise, for example, as indicated by arrow A; a charging device 20 (an example of a charging unit) that is provided facing to the electrophotographic photoreceptor 10 above the electrophotographic photoreceptor 10 and charges the surface of the electrophotographic photoreceptor 10 to a negative potential; an exposure device 30 (an example of an electrostatic latent image forming unit) that exposes the surface of the electrophotographic photoreceptor 10, which is charged by the charging device 20, to light to form an electrostatic latent image; a developing device 40 (an example of a developing unit) that attaches a toner, which is included in a developer, to the electrostatic latent image, which is formed by the exposure device 30, to form a toner image on the surface of the electrophotographic photoreceptor 10; a transfer device 50 that charges a recording paper P (recording medium) to have a polarity different from a charge polarity of the toner such that the toner image on the electrophotographic photoreceptor 10 is transferred onto the recording paper P; and a cleaning device 70 (an example of a toner removal unit) that cleans the surface of the electrophotographic photoreceptor 10. In addition, a fixing device 60 that fixes the toner image while transporting the recording paper P on which the toner image is formed, is provided.

Hereinafter, main components of the image forming apparatus 101 according to the exemplary embodiment will be described in detail.

Charging Device

Examples of the charging device 20 include contact charging devices using a charging roller, a charging brush, a charging film, a charging rubber blade, a charging tube, and the like which are conductive. In addition, examples of the charging device 20 include non-contact roller charging devices and well-known charging devices such as a scorotron charger or corotron charger using corona discharge. As the charging device 20, contact charging devices are preferable.

Exposure Device

Examples of the exposure device 30 include optical devices in which the surface of the electrophotographic photoreceptor 10 is exposed to light such as semiconductor laser light, LED light, and liquid crystal shutter light according to an image form. It is preferable that the wavelength of a light source fall within the spectral sensitivity range of the electrophotographic photoreceptor 10. It is preferable that the wavelength of a semiconductor laser light be in the near-infrared range having an oscillation wavelength of about 780 nm. However, the wavelength is not limited thereto. Laser light having an oscillation wavelength of about 600 nm or laser light having an oscillation wavelength of 400 nm to 450 nm as blue laser light may be used. In addition, in order to form a color image, as the exposure device 30, for example, a surface-emitting laser light source of emitting multiple beams is also effective.

Developing Device

The developing device 40 has, for example, a configuration in which a developing roller 41, which is arranged in a development area opposite the electrophotographic photoreceptor 10, is provided in a container that accommodates a two-component developer including toner and a carrier. The developing device 40 is not particularly limited as long as it uses a two-component developer for development, and adopts a well-known configuration.

The developer used in the developing device 40 will be described.

The developer may be a single-component developer including toner or a two-component developer including toner and a carrier.

The toner includes toner particles which contain, for example, a binder resin, a colorant, and, optionally, other additives such as a release agent; and, optionally, external additives.

In the toner particles, the average shape factor (the number average of shape factors represented by an expression of "Shape Factor=$(ML^2/A)\times(\pi/4)\times100$"; wherein ML represents the maximum lengths of particles and A represents the projection areas of particles) is preferably from 100 to 150, more preferably from 105 to 145, and still more preferably from 110 to 140. Furthermore, in the toner, the volume average particle diameter is preferably from 3 μm to 12 μm, more preferably from 3.5 μm to 10 and still more preferably from 4 μm to 9 μm.

The preparation method of the toner particles is not particularly limited, and examples thereof include a kneading and pulverizing method in which a binder resin, a colorant, and a release agent and optionally, a charge-controlling agent and the like are added, kneaded, pulverized, and classified; a method in which shapes of particles obtained using the kneading and pulverizing method are changed by mechanical shock or heat energy; an emulsion polymerization aggregation method in which a dispersion obtained by emulsifying and polymerizing polymerizable monomers of a binder resin, and a dispersion of a colorant, and a release agent and optionally, a charge-controlling agent, and the like are mixed, aggregated, heated, and coalesced to obtain toner particles; a suspension polymerization method in which polymerizable monomers for obtaining a binder resin and a solution having a colorant and a release agent and optionally a charge-controlling agent and the like are suspended in an aqueous solvent and polymerized; and a dissolving suspension method in which a binder resin and a solution having a colorant and a release agent and optionally a charge-controlling agent and the like are suspended in an aqueous solvent for granulation.

In addition, a well-known method such as a preparation method in which toner particles obtained in the above-described methods are used as a core and furthermore aggregated particles are attached thereto, followed by heating and coalescence to obtain a core-shell structure, is used. As the preparation method of toner, from the viewpoints of controlling the shape and the particle size distribution, the suspension polymerization method, the emulsion polymerization aggregation method, and the dissolving suspension method, which use an aqueous solvent for the preparation, are preferable and the emulsion polymerization aggregation method is particularly preferable.

The toner is prepared by mixing the toner particles and the external additives with a Henschel mixer, a V-blender, or the like. In addition, when toner particles are prepared according to a wet method, external addition may be performed according to a wet method.

In addition, when the toner is used for a two-component developer, the mixing ratio of the toner and a carrier is set to a well-known ratio. The carrier is not particularly limited, and a preferable example thereof includes a carrier in which the surfaces of magnetic particles are coated with a resin.

Transfer Device

Examples of the transfer device 50 include contact transfer charging devices using a belt, a roller, a film, a rubber blade, and the like; and well-known transfer charging devices such as scorotron transfer charger or corotron transfer charger using corona discharge.

Cleaning Device

The cleaning device 70 includes, for example, a case 71, a cleaning blade 72, a cleaning brush 73 which is disposed downstream of the cleaning blade 72 in a rotating direction of the electrophotographic photoreceptor 10. In addition, for example, the cleaning brush 73 is in contact with a solid lubricant 74.

Next, the operations of the image forming apparatus 101 according to the exemplary embodiment will be described. First, the electrophotographic photoreceptor 10 is charged to a negative potential by the charging device 20 while rotating along a direction indicated by arrow A.

The surface of the electrophotographic photoreceptor 10, which is charged to a negative potential by the charging device 20, is exposed to light by the exposure device 30 and an electrostatic latent image is formed thereon.

When a portion of the electrophotographic photoreceptor 10, where the electrostatic latent image is formed, approaches the developing device 40, toner is attached onto the electrostatic latent image by the developing device 40 (developing roller 41) and thus a toner image is formed.

When the electrophotographic photoreceptor 10 where the toner image is formed further rotates in the direction indicated by arrow A, the toner image is transferred onto the recording paper P by the transfer device 50. As a result, the toner image is formed on the recording paper P.

The toner image, which is formed on the recording paper P, is fixed on the recording paper P by the fixing device 60.

Figure 3:
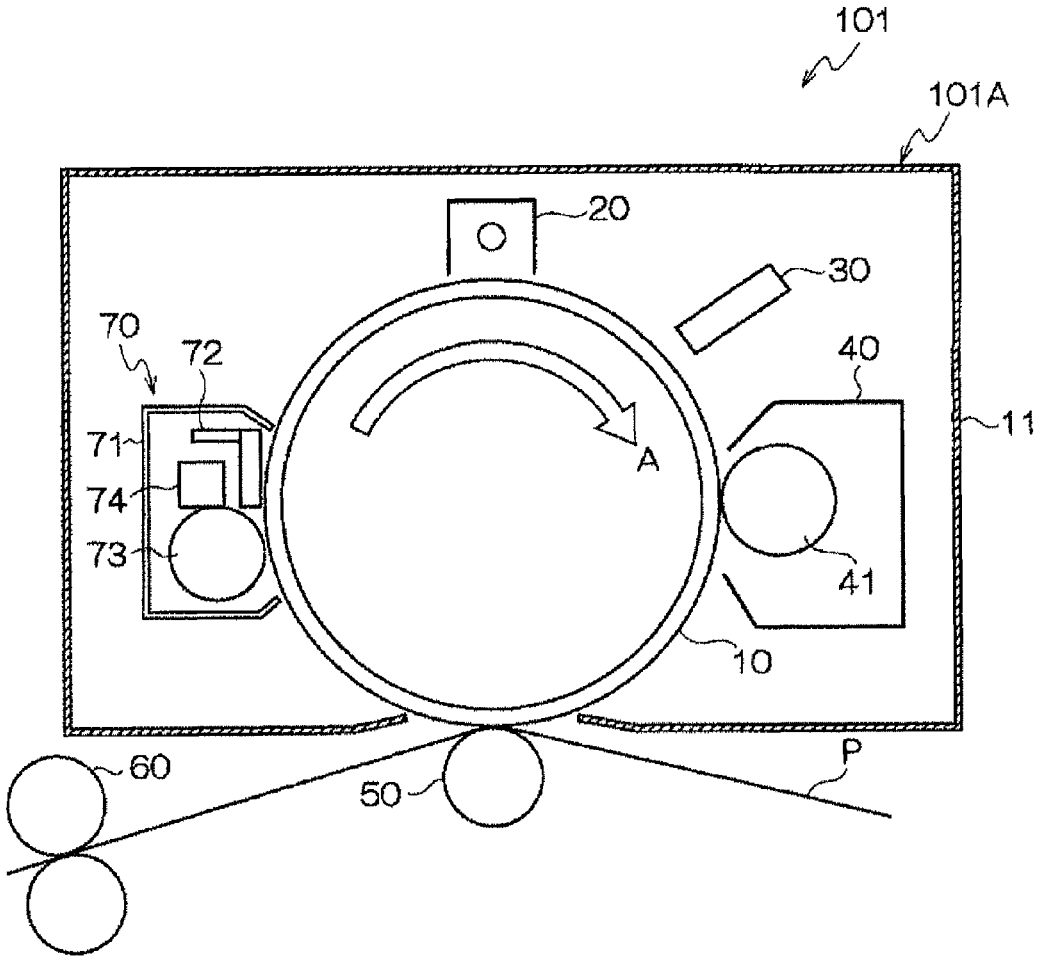
FIG. 3 is a diagram schematically illustrating a configuration of an image forming apparatus according to another exemplary embodiment of the invention.

For example, as illustrated in FIG. 3, the image forming apparatus 101 according to the exemplary embodiment may include a process cartridge 101A which integrally accommodates the electrophotographic photoreceptor 10, the charging device 20, the exposure device 30, the developing device 40, and the cleaning device 70 in the case 11. This process cartridge 101A integrally accommodates the plural members and is detachable from the image forming apparatus 101.

The process cartridge 101A is not limited to the above configuration as long as it includes at least the electrophotographic photoreceptor 10, and may further include at least one selected from the charging device 20, the exposure device 30, the developing device 40, the transfer device 50, and the cleaning device 70.

In addition, the image forming apparatus 101 according to the exemplary embodiment is not limited to the above-described configurations. For example, a first erasing device for aligning the polarity of remaining toner and facilitating the cleaning brush to remove the remaining toner may be provided downstream of the transfer device 50 in the rotating direction of the electrophotographic photoreceptor 10 and upstream of the cleaning device 70 in the rotating direction of the electrophotographic photoreceptor 10 in the vicinity of the electrophotographic photoreceptor 10; or a second erasing device for erasing the charge on the surface of the electrophotographic photoreceptor 10 may be provided downstream of the cleaning device 70 in the rotating direction of the electrophotographic photoreceptor 10 and upstream of the charging device 20 in the rotating direction of the electrophotographic photoreceptor 10.

In addition, the image forming apparatus 101 according to the exemplary embodiment is not limited to the above-described configurations and well-known configurations may be adopted. For example, an intermediate transfer type image forming apparatus, in which the toner image, which is formed on the electrophotographic photoreceptor 10, is transferred onto an intermediate transfer medium and then transferred onto the recording paper P, may be adopted; or a tandem-type image forming apparatus may be adopted.

EXAMPLES

Hereinafter, the present invention will be described in detail with reference to Examples and Comparative Examples but is not limited thereto.

Example 1

Photoreceptor 1

Formation of Undercoat Layer 100 parts by weight of zinc oxide (average particle diameter: 70 nm, manufactured by TAYCA CORPORATION, specific surface area: 15 $m^2/g$) and 500 parts by weight of toluene are stirred and mixed and 1.25 parts by weight of KBM 603 (manufactured by Shin-Etsu Chemical Co., Ltd.) as a silane coupling agent is added thereto, followed by stirring for 2 hours. Next, toluene is removed by distillation under reduced pressure, followed by baking at 120° C. for 3 hours. As a result, zinc oxide particles with surfaces treated with a silane coupling agent are obtained.

100 parts by weight of zinc oxide particles with the treated surfaces is added to 500 parts by weight of tetrahydrofuran, followed by stirring and mixing. Then, a solution in which 1 part by weight of alizarin is dissolved in 50 parts by weight of tetrahydrofuran is added thereto, followed by stirring at 50° C. for 5 hours. Next, zinc oxide particles with alizarin added are separated through filtration under reduced pressure, followed by drying under reduced pressure at 60° C. As a result, zinc oxide particles with alizarin added are obtained.

60 parts by weight of the obtained zinc oxide particles with alizarin added, 13.5 parts by weight of blocked isocyanate (SUMIDUR 3173, manufactured by Sumitomo Bayer Urethane Co., Ltd.) as a curing agent, and 15 parts by weight of butyral resin (BM-1, manufactured by SEKISUI CHEMICAL CO. LTD.) are dissolved in 85 parts by weight of methyl ethyl ketone to prepare a solution. 38 parts by weight of the obtained solution and 25 parts by weight of methyl ethyl ketone are mixed, followed by dispersion with a sand mill for 2 hours using glass beads with a diameter of 1 mm. As a result, a dispersion is obtained.

0.005 part by weight of dioctyl tin dilaurate as a catalyst and 40 parts by weight of silicone resin particles (TOSPEARL 145, manufactured by GE Toshiba Silicones Co., Ltd.) are added to the obtained dispersion, followed by drying and curing at 170° C. for 40 minutes. As a result, an undercoat-layer-forming coating solution is obtained. This coating solution is dip-coated on an aluminum substrate having a diameter of 60 mm, a length of 357 mm, and a thickness of 1 mm. As a result, an undercoat layer with a thickness of 20 μm is obtained.

Formation of Charge Generation Layer

Next, 1 part by weight of hydroxygallium phthalocyanine crystal (as a charge generation material) having diffraction peaks at Bragg angles (2θ±0.2°) with respect to CuKα characteristic X-rays of 7.5°, 9.9°, 12.5°, 16.3°, 18.6°, 25.1°, and 28.3° and 1 part by weight of polyvinyl butyral resin (trade name: S-LEC BM-S, manufactured by SEKISUI CHEMICAL CO., LTD.) are added to 100 parts by weight of butyl acetate, followed by dispersion for 1 hour with a paint shaker using glass beads. The obtained coating solution is dip-coated on the surface of the undercoat layer, followed by heat-drying at 100° C. for 10 minutes. As a result, a charge generation layer with a thickness of 0.2 μm is formed.

Formation of Charge Transport Layer

Furthermore, 2.1 parts by weight of compound represented by Structural formula 1 below and 2.9 parts by weight of polymer compound represented by Structural formula 2 below (viscosity average molecular weight: 39,000) are dissolved in 10 parts by weight of tetrahydrofuran and 5 parts by weight of toluene. As a result, a coating solution is obtained. The obtained coating solution is dip-coated on the surface of the charge generation layer, followed by heat-drying at 135° C. for 35 minutes. As a result, a charge transport layer with a thickness of 24 μm is formed.

Structural Formula 1

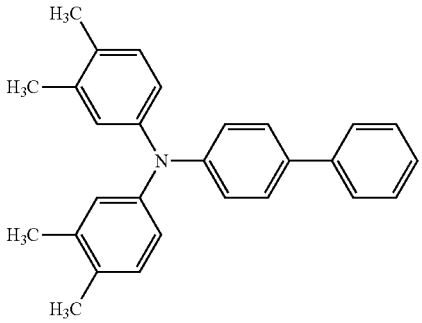

Structural Formula 2

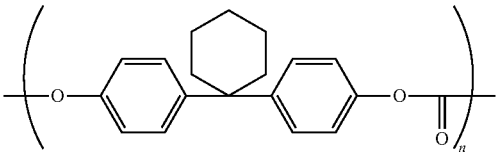

Formation of Protective Layer 10 parts by weight of LUBRON L-2 (manufactured by DAIKIN INDUSTRIES Ltd., average primary particle diameter: 0.2 nm) as polytetrafluoroethylene resin particles and 0.5 part by weight of alkyl fluoride group-containing copolymer which includes a repeating unit represented by Structural formula 3 (weight average molecular weight: 50,000; 13:m3=1:1; s3=1; n3=60) are added to 40 parts by weight of mixed solvent obtained by mixing cyclopentanone and cyclopentanol at 7:3, followed by stirring and mixing. Dispersion is repeatedly performed five times under increased pressure to 700 kgf/cm$^2$ using a high-pressure homogenizer (manufactured by Yoshida Kikai Co., Ltd., YSNM-1500AR) to which a pass-through chamber having a fine flow path is mounted. As a result, Polytetrafluoroethylene resin particle suspension (A) is prepared.

Structural Formula 3

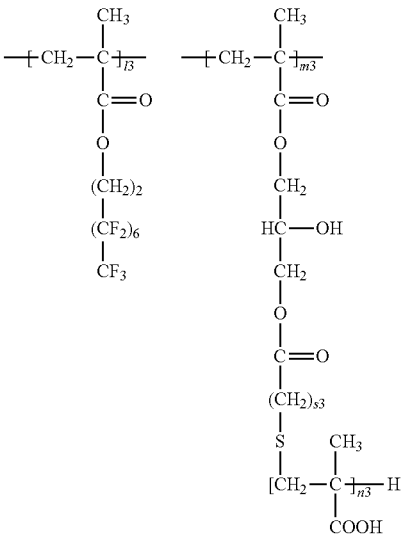

Next, 55 parts by weight of Exemplary compound (I-8) and 40 parts by weight of Exemplary compound (I-26) as the reactive charge transport material, 4 parts by weight of benzoguanamine resin (Exemplary compound (A)-17: NIKALAC BL-60, manufactured by SANWA CHEMICAL CO., LTD.), 1 part by weight of dimethylpolysiloxane (GLANOL 950, manufactured by KYOEISHA CHEMICAL CO., LTD.), and 0.1 part by weight of NACURE 5225 (manufactured by King Industries Inc.) are dissolved in a mixed solvent obtained by mixing cyclopentanone and cyclopentanol at 7:3, followed by stirring at 40° C. for 6 hours. As a result, Curable-film-forming solution (B) is prepared.

Furthermore, 110 parts by weight of Polytetrafluoroethylene resin particle suspension (A) and 100 parts by weight of Curable-film-forming solution (B) are mixed to prepare a protective-layer-forming coating solution.

The obtained protective-layer-forming coating solution is coated on the charge transport layer according to an ink jet coating method, followed by drying at 155° C. for 35 minutes. As a result, a protective layer with a thickness of 6 μm is formed.

Through the above-described processes, an electrophotographic photoreceptor is prepared. As a result, Photoreceptor 1 is obtained.

Example 2

Photoreceptor 2

An electrophotographic photoreceptor is prepared in the same method as that of Example 1, except that the amount of KBM 603 added is changed to 0.7 parts by weight and the amount of alizarin added is changed to 0.7 part by weight in the formation of Photoreceptor 1 (the undercoat layer thereof). As a result, Photoreceptor 2 is obtained.

Example 3

Photoreceptor 3

An electrophotographic photoreceptor is prepared in the same method as that of Example 1, except that the amount of KBM 603 added is changed to 1.0 part by weight, the amount of alizarin added is changed to 1.25 parts by weight, and the resin used for the charge generation layer is changed from polyvinyl butyral resin to vinyl chloride-vinyl acetate copolymer (trade name: VMCH, manufactured by Nippon Unicar Company Limited) in the formation of Photoreceptor 1 (the undercoat layer thereof). As a result, Photoreceptor 3 is obtained.

Example 4

Photoreceptor 4

An electrophotographic photoreceptor is prepared in the same method as that of Example 1, except that the amount of KBM 603 added is changed to 1.5 parts by weight, the amount of alizarin added is changed to 2.0 parts by weight, and the resin used for the charge generation layer is changed from polyvinyl butyral resin to vinyl chloride-vinyl acetate copolymer (trade name: VMCH, manufactured by Nippon Unicar Company Limited) in the formation of Photoreceptor 1 (the undercoat layer thereof). As a result, Photoreceptor 4 is obtained.

Example 5

Photoreceptor 5

An electrophotographic photoreceptor is prepared in the same method as that of Example 1, except that the amount of KBM 603 added is changed to 2.0 parts by weight, the amount of alizarin added is changed to 2.5 parts by weight, and the resin used for the charge generation layer is changed from polyvinyl butyral resin to vinyl chloride-vinyl acetate copolymer (trade name: VMCH, manufactured by Nippon Unicar Company Limited) in the formation of Photoreceptor 1 (the undercoat layer thereof). As a result, Photoreceptor 5 is obtained.

Example 6

Photoreceptor 6

An electrophotographic photoreceptor is prepared in the same method as that of Example 1, except that purpurin is used instead of alizarin in the formation of Photoreceptor 1 (the undercoat layer thereof). As a result, Photoreceptor 6 is obtained.

Comparative Example 1

Comparative Photoreceptor 1

An electrophotographic photoreceptor is prepared in the same method as that of Example 1, except that the amount of KBM 603 added is changed to 1.0 part by weight, the amount of alizarin added is changed to 0.5 part by weight, and the resin used for the charge generation layer is changed from polyvinyl butyral resin to vinyl chloride-vinyl acetate copolymer (trade name: VMCH, manufactured by Nippon Unicar Company Limited) in the formation of Photoreceptor 1 (the undercoat layer thereof). As a result, Comparative Photoreceptor 1 is obtained.

Comparative Example 2

Comparative Photoreceptor 2

An electrophotographic photoreceptor is prepared in the same method as that of Example 1, except that the amount of KBM 603 added is changed to 0.5 part by weight and alizarin is not used in the formation of Photoreceptor 1 (the undercoat layer thereof). As a result, Comparative Photoreceptor 2 is obtained.

Comparative Example 3

Comparative Photoreceptor 3

An electrophotographic photoreceptor is prepared in the same method as that of Example 1, except that KBM 603 and alizarin are not used and the resin used for the charge generation layer is changed from polyvinyl butyral resin to vinyl chloride-vinyl acetate copolymer (trade name: VMCH, manufactured by Nippon Unicar Company Limited) in the formation of Photoreceptor 1 (the undercoat layer thereof). As a result, Comparative Photoreceptor 3 is obtained.

Comparative Example 4

Comparative Photoreceptor 4

An electrophotographic photoreceptor is prepared in the same method as that of Example 1, except that the amount of KBM 603 added is changed to 2.5 parts by weight, the amount of alizarin added is changed to 2.5 parts by weight, and the resin used for the charge generation layer is changed from polyvinyl butyral resin to vinyl chloride-vinyl acetate copolymer (trade name: VNCH, manufactured by Nippon Unicar Company Limited) in the formation of Photoreceptor 1 (the undercoat layer thereof). As a result, Comparative Photoreceptor 4 is obtained.

Evaluation

Properties of Photoreceptor

Regarding the respective photoreceptors obtained in the respective examples, the work function WUCL of an undercoat layer and the work function WCGL of a charge generation layer are measured according to the above-described method. The results are shown in Table 1.

Evaluation for Ghost

An image formation test is conducted using the respective photoreceptors obtained in the respective examples.

Specifically, the evaluation for ghost is conducted in which the respective photoreceptors obtained in the respective examples are mounted to DocuCentre-II C 7500 (manufactured by Fuji Xerox Co., Ltd.); halftone images having 10 $mm^2$ solid black patches and an area coverage of 50% are printed; and the histories of the solid black patches appearing on the halftone images are considered as ghosts and are normalized using the difference between reflection densities of ghost portions and normal portions for evaluating ghosts. The results are shown in Table 1.

In this case, the evaluation criteria are as follows.

G4: The difference between reflection densities of ghost portions and normal portions is greater than or equal to 0.03

G3: The difference between reflection densities of ghost portions and normal portions is greater than or equal to 0.02 and less than 0.03

G2: The difference between reflection densities of ghost portions and normal portions is greater than or equal to 0.01 and less than 0.02

G1: The difference between reflection densities of ghost portions and normal portions less than 0.01

G0: No ghosts are found

Evaluation for Other Image Quality Defects

During the evaluation for ghost, other image quality defects are evaluated by visual inspection.

TABLE 1

| | | WUCL (eV) | WCGL (eV) | WCGL-WUCL (eV) | Ghost | Other Image Quality Defects |
|---|---|---|---|---|---|---|
| Example 1 | Photoreceptor 1 | 4.52 | 4.36 | −0.16 | G1 | None |
| Example 2 | Photoreceptor 2 | 4.42 | 4.36 | −0.06 | G2 | None |
| Example 3 | Photoreceptor 3 | 4.52 | 4.33 | −0.19 | G1 | None |
| Example 4 | Photoreceptor 4 | 4.55 | 4.33 | −0.22 | G1 | None |
| Example 5 | Photoreceptor 5 | 4.70 | 4.33 | −0.37 | G0 | None |
| Example 6 | Photoreceptor 6 | 4.45 | 4.36 | −0.09 | G2 | None |
| Comparative Example 1 | Comparative Photoreceptor 1 | 4.30 | 4.33 | 0.03 | G3 | None |
| Comparative Example 2 | Comparative Photoreceptor 2 | 4.05 | 4.36 | 0.31 | G4 | None |
| Comparative Example 3 | Comparative Photoreceptor 3 | 3.95 | 4.33 | 0.38 | G4 | None |

TABLE 1-continued

| | | WUCL (eV) | WCGL (eV) | WCGL-WUCL (eV) | Ghost | Other Image Quality Defects |
|---|---|---|---|---|---|---|
| Comparative Example 4 | Comparative Photoreceptor 4 | 4.75 | 4.33 | −0.42 | G0 | Deterioration in Density Due to Continuous Printing |

It can be seen from the above results that, when the Examples are compared to the Comparative Examples, superior results are obtained in the evaluation for ghost in the Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A negative-charge type electrophotographic photoreceptor, comprising:

a conductive substrate;

an undercoat layer having a thickness of from 20 μm to 50 μm, and a work function of from 4.0 eV to 4.7 eV, the undercoat layer comprising:

a binder resin, metal oxide particles, a content of the metal oxide particles being from 10% by weight to 80% by weight with respect to the binder resin, and an electron-accepting compound having an anthraquinone structure, a content of the electron-accepting compound being from 0.01% by weight to 20% by weight with respect to the metal oxide particles;

a charge generation layer comprising a binder resin and a charge generation material, wherein a difference between a work function of the charge generation layer and the work function of the undercoat layer is from −4 eV to 0 eV; and a charge transport layer which is provided on the charge generation layer.

2. The electrophotographic photoreceptor according to claim 1, wherein the work function of the undercoat layer is from 4.2 eV to 4.7 eV.

3. The electrophotographic photoreceptor according to claim 1, wherein the difference between the work function of the charge generation layer and the work function of the undercoat layer is from −3.5 eV to −0.05 eV.

4. The electrophotographic photoreceptor according to claim 1, wherein the work function of the charge generation layer is from 4.1 eV to 4.5 eV.

5. The electrophotographic photoreceptor according to claim 1, wherein a volume average particle diameter of the metal oxide particles is in a range of from 50 nm to 500 nm.

6. The electrophotographic photoreceptor according to claim 1, wherein the electron-accepting compound is a compound selected from the group consisting of anthraquinone, alizarin, quinizarin, anthrarufin, and purpurin.

7. A process cartridge, comprising:

the electrophotographic photoreceptor according to claim 1; and at least one unit selected from (A) a charging unit that charges a surface of the electrophotographic photoreceptor, (B) a latent image forming unit that forms an electrostatic latent image on a charged surface of the electrophotographic photoreceptor, (C) a developing unit that develops the electrostatic latent image, which is formed on the surface of the electrophotographic photoreceptor, using a toner to form a toner image, (D) a transfer unit that transfers the toner image, which is formed on the surface of the electrophotographic photoreceptor, onto a recording medium, and (E) a cleaning unit that cleans the electrophotographic photoreceptor.

8. An image forming apparatus, comprising:

the electrophotographic photoreceptor according to claim 1;

a charging unit that charges a surface of the electrophotographic photoreceptor;

a latent image forming unit that forms an electrostatic latent image on a charged surface of the electrophotographic photoreceptor;

a developing unit that develops the electrostatic latent image, which is formed on the surface of the electrophotographic photoreceptor, using a toner to form a toner image; and a transfer unit that transfers the toner image, which is formed on the surface of the electrophotographic photoreceptor, onto a recording medium.

9. The image forming apparatus according to claim 8, wherein the work function of the undercoat layer of the electrophotographic photoreceptor is from 4.2 eV to 4.7 eV.

10. The image forming apparatus according to claim 8, wherein the difference between the work of the charge generation layer and the work function of the undercoat layer of the electrophotographic photoreceptor is from −3.5 eV to −0.05 eV.

11. The electrophotographic photoreceptor according to claim 1, wherein the metal oxide particles are particles of zinc oxide, titanium oxide, tin oxide, or indium oxide.

12. The electrophotographic photoreceptor according to claim 1, wherein the charge generation material is hydroxygallium phthalocyanine or chlorogallium phthalocyanine.

13. The electrophotographic photoreceptor according to claim 1, wherein the binder resin of the charge generation layer is polyvinyl butyral or vinyl chloride-vinyl acetate copolymer.

* * * * *